US006953363B2

(12) United States Patent
Kameyama et al.

(10) Patent No.: US 6,953,363 B2
(45) Date of Patent: Oct. 11, 2005

(54) AUXILIARY DEVICE MODULE

(75) Inventors: Isao Kameyama, Shizuoka (JP); Takakazu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 13 days.

(21) Appl. No.: 09/987,909

(22) Filed: Nov. 16, 2001

(65) Prior Publication Data

US 2002/0061676 A1 May 23, 2002

(30) Foreign Application Priority Data

Nov. 17, 2000 (JP) ..... 2000-351819

(51) Int. Cl.[7] ..... H01R 4/24
(52) U.S. Cl. ..... 439/404; 439/417
(58) Field of Search ..... 439/404, 407, 439/417

(56) References Cited

U.S. PATENT DOCUMENTS 4,954,098 A * 9/1990 Hollingsworth et al. .... 439/404
5,567,173 A * 10/1996 Franckx ..... 439/418
5,662,493 A * 9/1997 Reichle ..... 439/407
5,675,890 A * 10/1997 Yamamoto et al. ..... 29/861
5,890,924 A * 4/1999 Endo et al. ..... 439/417
6,079,848 A * 6/2000 Ahroni ..... 362/249

FOREIGN PATENT DOCUMENTS

JP 7-42075 7/1995

* cited by examiner

*Primary Examiner*—Renee Luebke
(74) *Attorney, Agent, or Firm*—Armstrong, Kratz, Quintos, Hanson & Brooks, LLP

(57) ABSTRACT

An auxiliary device module Z includes: an auxiliary device 1; a base board 2 mounted on the auxiliary device 1 which has terminals 5*e*; and a case 3 in which the base board 2 can be mounted. Fitting the base board 2 into the case 3, the terminals 5*e* of the base board 2 and electric wires 4 of a connecting portion 5*e*' in the case 3 are connected electrically to form a connector 5. Positioning portions 6 for guiding the terminals 5*e* are provided in the connecting portion 5*e*'. Thereby, when assembling the auxiliary device module Z, connecting electrically the terminal 5*e* with the electric wires 4 can be done simultaneously, accurately and easily.

9 Claims, 14 Drawing Sheets

AUXILIARY DEVICE MODULE

BACKGROUND OF THE INVENTION

1. Field of the Invention

This invention relates to an auxiliary device module with high manufacturability and high yield by connecting electrically an auxiliary device, such as a car-mount type CCD camera, and a base board mounted on the auxiliary device and a case, on which the auxiliary device and the board can be mounted, by means of a connector.

2. Description of the Related Art

A camera module Y, Z by prior art will be described with reference to FIGS. 19–22. FIG. 19 is a partial expanded view of a wire harness 4 provided with a clamp 10 having an O-ring 11. The O-ring 11 is provided in the clamp 10 to keep a camera case 3 airtight when mounting the clamp 10 on the camera case 3.

The clamp 10 is provided with a thread portion 10*a* for fixing the clamp securely on a camera case and a hexagon head portion 10*b* to be used when the clamp 10 is fixed on a camera case by thread fastening and a flange 10*c* to generate fastening force between the clamp 10 and the camera case 3 and perform keeping the O-ring 11 airtight.

The clamp 10 is provided inside thereof with a through hole 10*d* to run electric wires or the like, such as cables 4*a*, 4*a*', through. As shown in FIG. 19, electric wires of cables 4*a*, 4*a*' including a drain wire 4*a*' run through the through hole 10*d* of the clamp 10 having the O-ring 11. Terminals 5*p* are mounted on the end of respective cable 4*a*, 4*a*'.

After putting the cables 4*a*, 4*a*' through the through hole 10*d* of the clamp 10, potting process 12 is done. Describing potting process 12 simply, it is sealing by pouring soft rubber or soft resin such as epoxy polymer in required portion.

Sealing for each cable 4*a*, 4*a*' can be done completely by potting process 12. Then, penetrating of water or dust into inside of a camera case or camera is prevented. Sealing test on a potting processed portion can be done by leakage test on water or air.

FIG. 20 and FIG. 21 are perspective views, showing assembling process of camera modules Y, Z with a car-mount type CCD camera by prior art. A camera module Y with a car-mount type CCD camera by prior art will be described simply here. The camera module Y includes a camera 1 such as a car-mount type CCD camera and a base board 2 mounted with the camera 1. A camera module Z is provided with a camera module Y having a camera 1 and a base board 2, a camera case 3 mounted with the camera module Y and a wire harness 4 formed with bound various cables 4*a*, 4*a*'.

FIG. 20 and FIG. 21 show assembling process of a car-mount type CCD camera by prior art. FIG. 21 is a perspective view, showing wrong condition when mounting the camera module Y with the camera 1 and the base board 2 on the camera case 3. FIG. 22 is a conceptual drawing, showing a sectional view taken along the line R—R of FIG. 20, 21 and connection of the wire harness 4, specifically showing a condition of mounting the wire harness 4 on the camera case 3 through the clamp 10 by partially expanded view.

Each part of the camera module Z by prior art shown in FIGS. 20–22 is described in detail. The camera 1 is provided with a lens 1*c* and a lens area portion id to hold the lens 1*c*. The base board 2 mounted with the camera 1 includes mainly a base board body 2' provided with electric elements such as connectors for electrical connecting. The base board body 2' is provided with a connector housing 2*c* as a connector related element. The base board body 2' is also provided at four locations near four corners thereof with screw through holes 2*b* for fixing the base board 2 on the camera case 3 by fastenings such as screws 13*b*.

The camera case 3 is formed with a bottom wall 3*c* and side walls 3*d*, 3*d*' standing around the bottom wall to provide a receiving section 3*e*. The side wall 3*d*' is provided with a cylindrical projection 3*g* for fixing the clamp 10 and sealing the camera case 3. The camera case 3 is provided on four corners in an inside of the receiving section 3*e* with screw fixing bodies 3*a* for fixing the base board 2 mounted with the camera 1 thereon. Each screw fixing body 3*a* has a tapped hole 3*b*.

Joint structure of the clamp 10 and the camera case 3 shown in FIG. 20, 21 is described in detail with reference to FIG. 22. The camera case 3 is provided on the side wall 3*d*' with a through hole 3*f* for putting the wire harness 4 formed by bound cables 4*a*, 4*a*' through. The through hole 3*f* is formed inside wall thereof with internal tread portion to combine with the thread portion 10*a* of the clamp 10 for fastening.

The clamp 10 with led cables 4*a*, 4*a*' shown in FIG. 19 through is mounted in the through hole 3*f* formed on the side wall 3*d*' of the camera case 3. Combining the thread portion 10*a* of the clamp 10 and the through hole 3*f*, formed with thread, of the camera case 3, the clamp 10 with led wire harness 4 shown in FIG. 24 through is fixed on the camera case 3.

The camera case 3 is provided around the through hole 3*f* with the cylindrical projection 3*g* for guiding the clamp 10 with the O-ring 11, mentioned above, into the through hole 3*f*. The cylindrical projection 3*g* performs shield plate to keep hermetic sealing by the O-ring mounted on the clamp 10 and to prevent penetrating of water or dust from outside.

The wire harness 4, as shown in FIG. 22, connects the camera case 3 and a non-waterproof connector 5*r* mounted in an inside-of-car V. The drain wire 4*a*' branched at a middle portion of the wire harness 4 is provided at the end with a terminal 5*s* and the terminal 5*s* is mounted on a frame of a car body B by means of a screw 13*c*. Thus, the drain wire 4*a*' performs earth ground.

Inserting a connector housing 5*q* joined with the cables 4*a*, 4*a*' into connector housing 2*c*, as shown in FIGS. 20, 21, builds a connector and connects electrically the cables 4*a*, 4*a*' and the camera 1 such as a car-mount type CCD camera. Thus, the base board 2 with the camera 1, the wire harness 4, the non-waterproof connector 5*r* mounted in the inside-of-car V, the drain wire 4*a*' and the like are respectively connected electrically.

An example of assembling process for a car-mount type CCD camera by prior art will be described in detail as follows. The clamp 10 with the O-ring 11 is mounted on the wire harness 4, shown in FIG. 19. After inserting the wire harness 4 formed by bound cables 4*a*, 4*a*' through the through hole 10*d* of the clamp 10, the wire harness 4 and the clamps 10 are temporally fixed.

On a portion of the wire harness 4 from the clamp 10 inward the camera case 3, a tube 4*d* for binding and protecting cables 4*a*, 4*a*' is cleaved by a cutter or the like for pulling the cables 4*a*, 4*a*' out from the tube 4*d*. The terminals 5*p* are joined with the end of respective cables 4*a*, 4*a*' and the terminals 5*p* are received in the connector housing 5*q*, shown in FIG. 20, to build up connector related elements.

To improve sealing performance of such wire harness 4 and the clamp 10, potting process 12 by pouring resign or rubber into the through hole 10*d* of the clamp 10 is done and the both of the wire harness and the clamp is fixed, as shown in FIG. 19. The potting process shown in FIGS. 19 and 22 enhances airtight performance of the camera case 3.

Assembling operation of the electric wire 4 and related elements as mentioned above can be called as "assembling of the wire harness 4 and a connector" or more simply "connector assembling". The clamp 10 is fixed at a suitable position of the wire harness 4 for allowing the cables 4*a*, 4*a*' to have an extra length to connect the camera case 3 with the base board 2, as shown in FIGS. 20 and 21.

The clamp 10, inserting the cables 4*a*, 4*a*' therein, mentioned above, is mounted into the through hole 3*f* of the camera case 3, as shown in FIG. 22. Thereafter, combining the thread portion 10*a* of the clamp 10 including the O-ring 11 with the through hole 3*f* (treaded hole) of the camera case 3, the clamp 10 is fixed on the camera case 3 as shown in FIG. 20–22. The O-ring 11 and potting process 12 give airtight and sealing performance of the camera case 3, as shown in FIG. 22.

After above operation, the camera module Y which is the base board 2 mounted with the camera 1 is set in the camera case 3. The operation process, as shown in FIG. 20, 21, is connecting the connector elements, including the connector housing 5*q* provided in the wire harness 4, with the connector elements including the connector housing 2*c* mounted on the base board body 2'.

After connecting connectors or the like mentioned above, the camera module Y is mounted on the camera case 3. Regarding mounting process, the camera module Y provided with the camera 1 and the base board 2 is mounted on the camera case 3 to place the screw through hole 2*b* provided in the base board 2 correspondingly to the tapped hole 3*b* provided on the four corners of the camera case 3.

Inserting the screws 13*b* into each the screw through hole 2*b* provided in the base board body 2', the screws are turned by a screw fastening means. Then, the screws 13*b* go into the tapped holes 3*b* provided on the camera case 3. Thus, the camera module Y is fixed on the camera case 3 and then the camera module Z is assembled.

When looking related arts, J.U.M. Application Laid-open H7-42075 exists. J.U.M. H7-42075 describes a connector connecting system and discloses a wire alignment and hold mechanism to align automatically respective pair wire without changing coupled order on a connector connecting system to connect automatically respective conductive core wire of a plurality of pair wires into a temporally fixing connector cover.

However, according to a camera module Y by prior art, as shown in FIGS. 20 and 21, operation for connecting the camera module Y and a connector joined with the end of the cable 4*a* is done manually and then complicated work is required to operators. Furthermore, operations of placing the cables 4*a*, 4*a*' in the receiving section 3*e* of the camera case 3 and fixing them by the clamp 10 and connecting connectors are poor efficient work.

Describing an actual case, the camera case 3 by prior art is provided with the through hole 3*f* for inserting the cables 4*a*, 4*a*' therein and the cables 4*a*, 4*a*' with a connector is put through the through hole 3*f* and the connector is connected with a connector mounted on the base board 2. Such operation is very complicated for operators.

The camera case 3 by prior art is provided with the through hole 3*f* for inserting the cables 4*a*, 4*a*' and the through hole 3*f* is threaded. Keeping sealing performance of the through hole 3*f*, operation of screwing the clamp 10 into the thread portion and fixing the clamp 10 with the wire harness 4 on the camera case 3 is required.

FIG. 21 is a perspective view at a time of bad situation occurred during mounting the camera module Y on the camera case 3. During mounting the camera module Y by prior art on the camera case 3, it is feared that the cables 4*a*, 4*a*' are bitten by the camera module Y and the camera case 3 as shown in FIG. 21.

In addition to above issue of biting the cables 4*a*, 4*a*', even if electrical connection is done with a connector provided with pressure contact terminals, the operation for connecting electrically a pressure contact terminal and corresponded electric wire may be done by watching from oblique direction through a gap between the base board 2 and the camera case 3 or by blind touch. Such operation requires much attentiveness and load for operators and manufacturability is low. Unsecured pressure contact connection is also concerned.

SUMMARY OF THE INVENTION

One object of this invention is to provide an auxiliary device module which is miniaturized and reduced in weight by minimizing a number of elements provided around the auxiliary device such as a camera, connecting electric wires such as a wire harness and a base board having the auxiliary device such as a camera and terminals such as pressure contact type terminals simultaneously when mounting the base board onto a case.

Furthermore, the other object is to overcome the above drawback of biting electric wires such as cables being when mounting the base board provided with an auxiliary device such as a camera on a case, as shown in FIG. 21. Simultaneously, reduction of fraction defective when connecting electrically connectors and speed-up and higher efficiency of assembling operation are the other objects.

Specifically, the object is that a slit of a pressure contact blade provided in a pressure contact type connector abuts on a right position of an electric wire such as a cable or a conductive core wire and contacts it securely. Other object is to provide an auxiliary device module which has no failure of electrical connection caused by deforming a pressure contact blade of a pressure contact type terminal expanded.

In order to attain the objects, according to the invention, there is provided an auxiliary device module including an auxiliary device, a base board provided with the auxiliary device and terminals and a case for mounting the base board thereon. The terminals on the base board and a connecting portion inside the case are electrically connected as a connector by mounting the base board on the case. A positioning portion for the terminals is provided on the connecting portion of the connector.

Since a base board mounted with an auxiliary device and a case are modularized by above means and number of related elements can be reduced, the auxiliary device module is miniaturized and reduced on weight and also assembly structure is simplified. Mounting the base board provided with an auxiliary device and terminals on the case, assembling and electrical connecting can be done simultaneously.

No defective units concerned during assembling by prior art can be realized. On a device by prior art, while mounting the base board provided with an auxiliary device on the case, an electric wire may be bitten by a gap between the base board and the case. Such auxiliary device module with bitten electric wire is judged as a defective unit by concerning open circuit in an electric wire inside.

Abandoning such unfinished products is undesirable for terrestrial environment and wasteful on manufacturing. Then, reassembling such modules to replace elements related with electric wires is required. According to this invention, such defective units can be eliminated without such troublesome operations.

Furthermore, since a connecting portion of the connector formed in the auxiliary device module is provided with a positioning portion for terminals, the terminals are set accurately into required positions of the connector and then electric connection can be done when mounting a base board with the terminals on the case. Thus, operators are not required to pay too much attention for a connector when assembling an auxiliary device module and connecting of connectors assembled by automatic assembling machines is satisfactory. Therefore, speed-up and enhancement on assembling operation can be done and then, a low cost and low fraction defective auxiliary device module can be provided.

An auxiliary device module according to the invention is the auxiliary device module mentioned above, wherein the terminals are pressure contact type terminals, wherein the connecting portion has electric wires, wherein a pressure contact type connector provided with the pressure contact type terminals is mounted on the base board, wherein the case is provided with a connector housing having the electric wires therein, wherein the connector is formed by press-fitting the base board into the case to connect the pressure contact type terminals with the electric wires by pressure, wherein the positioning portion is formed with electric wire setting portions and pressure contact blade receiving grooves, wherein pressure contact connection is done by leading the pressure contact blades into the pressure contact blade receiving grooves.

Thus, operation of electrical connecting can be done easily by pressure contacting connection with pressure contact type terminals. Describing the operation for connecting electric wires with pressure contact type terminals, a pressure contact blade formed on a pressure contact type terminal is pressed on an electric wire such as a cable protected with an insulation cover and a sharp slant portion of the pressure contact type terminal is shearing the cable insulation cover made of resin or rubber and a conductive wire insulation coating such as enamel coating.

Pressing the terminal more, a pressure contact slit formed in the center area of the pressure contact type terminal shears the cable insulating cover more and contacts an inductive wire in the cable. Therefore, stripping the insulating cover and contacting the conductive wire are done simultaneously.

Thus, electrical connecting is given by contacting a U-shape pressure contact slit with an inductive wire in a cable or in an enamel coated wire. In short, electrical connection is given by pressing a pressure contact blade on a required portion of a covered inductive wire of a cable or an enamel coated wire. Since operation of assembling a base board, with an auxiliary device and a pressure contact type connector mentioned above, and a case and operation of pressure contacting connection mentioned above can be done together and simultaneously, electrical connection can be done by assembling a base board provided with an auxiliary device and a case.

Regarding an auxiliary device module by prior art, operation of connecting a pressure contact type terminal with an electric wire requires to pay much attention. An auxiliary device module failed in continuity test after operating pressure contact connection must be treated as a defective product.

If pressure contact connection is applied again on the same position of the electric wire which had be sheared once by a pressure contact type terminal, the second electrical disconnection on the position is concerned. Therefore, an electric wire applied pressure contact connection must be replaced or the other position of the electric wire instead of the position applied pressure contact connection previously may be connected with a pressure contact type terminal.

However, in a module according to this invention, an auxiliary device module is provided in the positioning portion with pressure contact blade receiving grooves for guiding pressure contact type terminals into the connector and then, when mounting a base board mounted with the pressure contact type terminals on a case, electrical connection can be done by guiding securely the pressure contact type terminals on the electric wires in a connector housing. Therefore, failed products mentioned above can be reduced and product yield can be improved.

Describing in detail, since a connector housing is provided in positioning portions with pressure contact blade receiving grooves for leading pressure contact type terminals and pressure contact connection is done by leading pressure contact type terminals into pressure contact blade receiving grooves, the slits of the pressure contact type terminals are successfully led to contact with electric wires such as cables provided in the connector when fitting the base board provided with the pressure contact type terminals into the case. The pressure contact blades of the pressure contact type terminals dig into electric wires such as cables with guide of pressure contact blade receiving grooves. Therefore, the pressure contact blades may not be expanded easily and electrically connecting can be done securely.

An auxiliary device module according to the invention is the auxiliary device module mentioned above, wherein a pair of the pressure contact blades formed in the pressure contact type terminal is guided by corner edges of the pressure contact blade receiving groove inwardly.

Applying such means on the auxiliary device module, a pair of the pressure contact blades formed in the pressure contact type terminal are guided by corner edges of the pressure contact blade receiving grooves and a pair of the pressure contact blades of the pressure contact type terminal are guided inwardly, when the pressure contact type terminals are connected with electric wires and a pair of the pressure contact blades of the pressure contact type terminal may be expanded outwardly.

If a pair of the pressure contact blades of the pressure contact type terminal may be expanded markedly when pressure contact connecting the pressure contact type terminals with electric wires, deformation of the pressure contact blades of pressure contact type terminals is concerned. When the pressure contact blades of pressure contact type terminals are deformed, pressure contact type terminals and electric wires may not be connected securely. However, according to this invention, a pair of the pressure contact blades of the pressure contact type terminal are guided inwardly by the corner edges of the pressure contact blade receiving grooves and then above failure can be prevented.

An auxiliary device module according to the invention is the auxiliary device module mentioned above, wherein a camera module is built with a car-mount type camera as said auxiliary device.

Applying the auxiliary device module according the invention for camera module mounted in a car, number of elements related with the camera module can be reduced and then, the camera module mounted in a car can be miniaturized and the weight and the cost also can be reduced.

Assembling structure of a camera, a base board and a case for a car is simplified. Using pressure contact type terminals, the structure differs from a current camera module in which a crimp contact type terminal is joined with a cable and connected with a connector for a board and electrical connection is done by a pressure contact type connector and then inspection, disassemble and repair can be done easily and also the camera module having good recyclability can be provided. The above and other objects and features of this invention will become more apparent from the following description taken in conjunction with the accompanying drawings.

DESCRIPTION OF THE PREFERRED EMBODIMENTS

A camera module Z as an embodiment of an auxiliary device module according to this invention will now be described with reference to FIGS. 1–18. The same named elements as respective elements in the example by prior art, mentioned above, are put with the same number and the detailed description on the structure is omitted.

Figure 1:
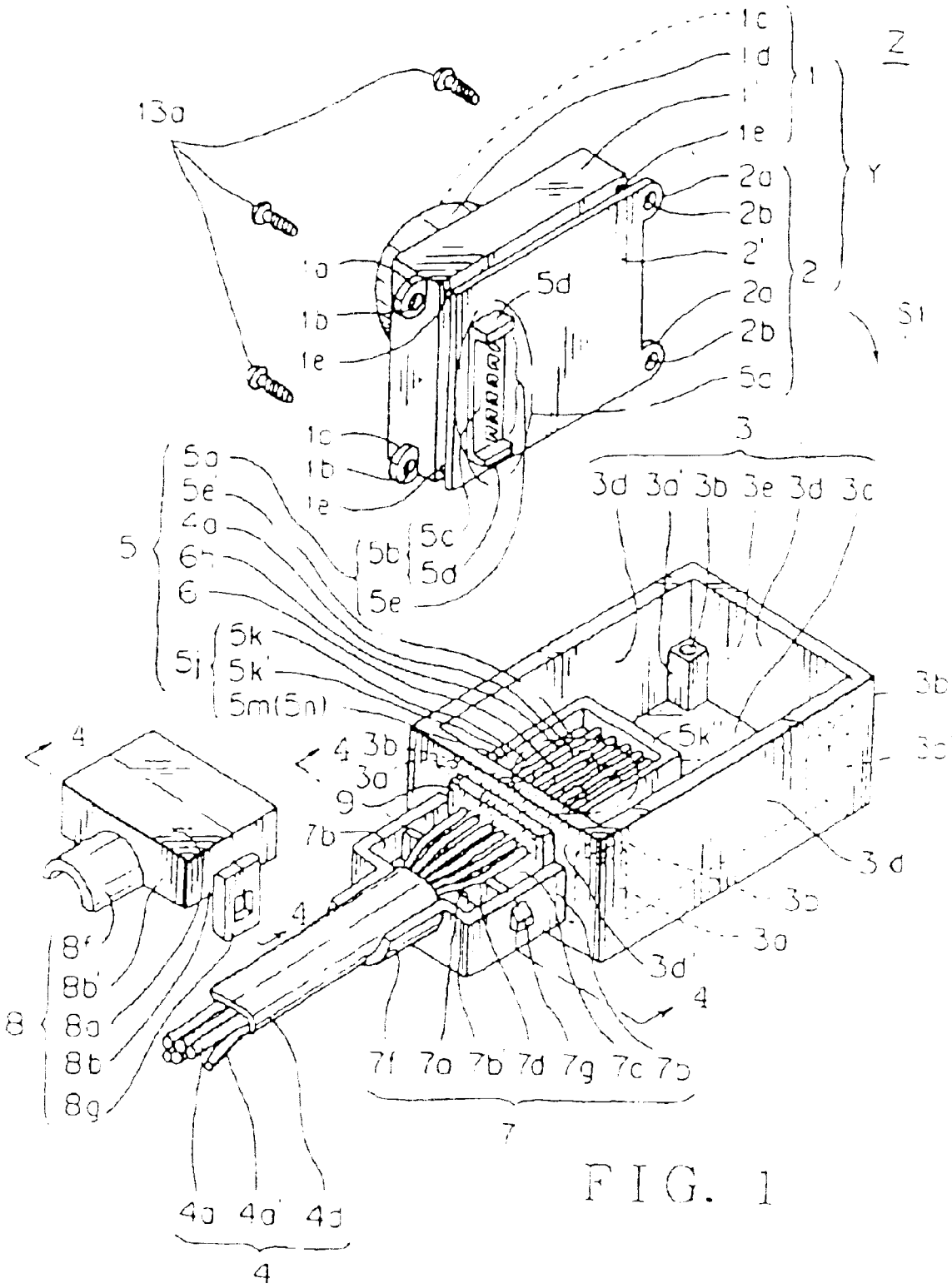
FIG. 1 is an exploded perspective view of one embodiment of an auxiliary device module according to the invention.

Regarding definition of upper-and-lower and front-and-rear direction in FIG. 1, a side of a lens 1*c* in an assembled camera module Z is the upper side and a side of a bottom wall 3*c* in a camera case 3 is the lower side. A direction of an electric wire 4, such as a wire harness 4, extending from the camera case 3 is the front side or this side and the opposite direction is the rear side or the back side.

Assembly provided with at least two elements like an auxiliary device 1 such as a camera 1 having a base board 2 is defined as an auxiliary device module Y and specifically is called a camera module Y. Assembly provided with at least three elements like an auxiliary device 1 such as a camera 1 and a base board 2 mounted on the auxiliary device 1 such as the camera 1 and the camera case 3, on which such base board 2 is mounted, is defined as an auxiliary device module Z and specifically is called a camera module Z. In this invention, the camera modules Y or Z can be called a crowned body.

A connector in this invention is defined as a member provided with electrical connecting elements, like a connector housing, terminals, a terminal portion and an electric wire, for electrical connecting. A connector according to this invention may be additionally provided with a packing, a rubber plug or a rear holder. Regarding a connector, a connector provided with male terminals is called a male connector in general and a connector provided with female terminals is called a female connector. However, in this invention, a member provided with at least a terminal and a connector housing is called a connector.

An electric wire 4 in this invention gives a generic name to a wire harness 4, a cable 4*a* or a core wire including a drain wire 4*a*', or a conductive wire 4*b* without coating. Describing the cable 4*a* or 4*a*' in this invention, the cable 4*a* or 4*a*' is called core wire and is formed with one inductive wire 4*b* or a plurality of the inductive wires 4*b* coated by a insulation cover 4*c* or enamel material.

A CCD camera or a MOS (Metal Oxide Semiconductor) camera or any kind of camera can be used for a camera in this invention.

Outline of assembling operation for a camera module Z will be described with reference to FIGS. 1 and 2. Expanded some specific area in FIGS. 1, 2 will be described with reference to FIGS. 3–8. Example of assembling operation for the other camera module Z will be described with reference to FIGS. 9–18.

FIG. 1 is an exploded perspective view of one embodiment of an auxiliary device module Z according to the invention, showing a camera module Z as the auxiliary device module Z. FIG. 2 is a conceptual drawing to show a top view of a camera case 3 shown in FIG. 1 and connection of a wire harness 4, showing minutely a inside of a connector housing 5*j* shown in FIG. 1 and relative portions.

Figure 2:
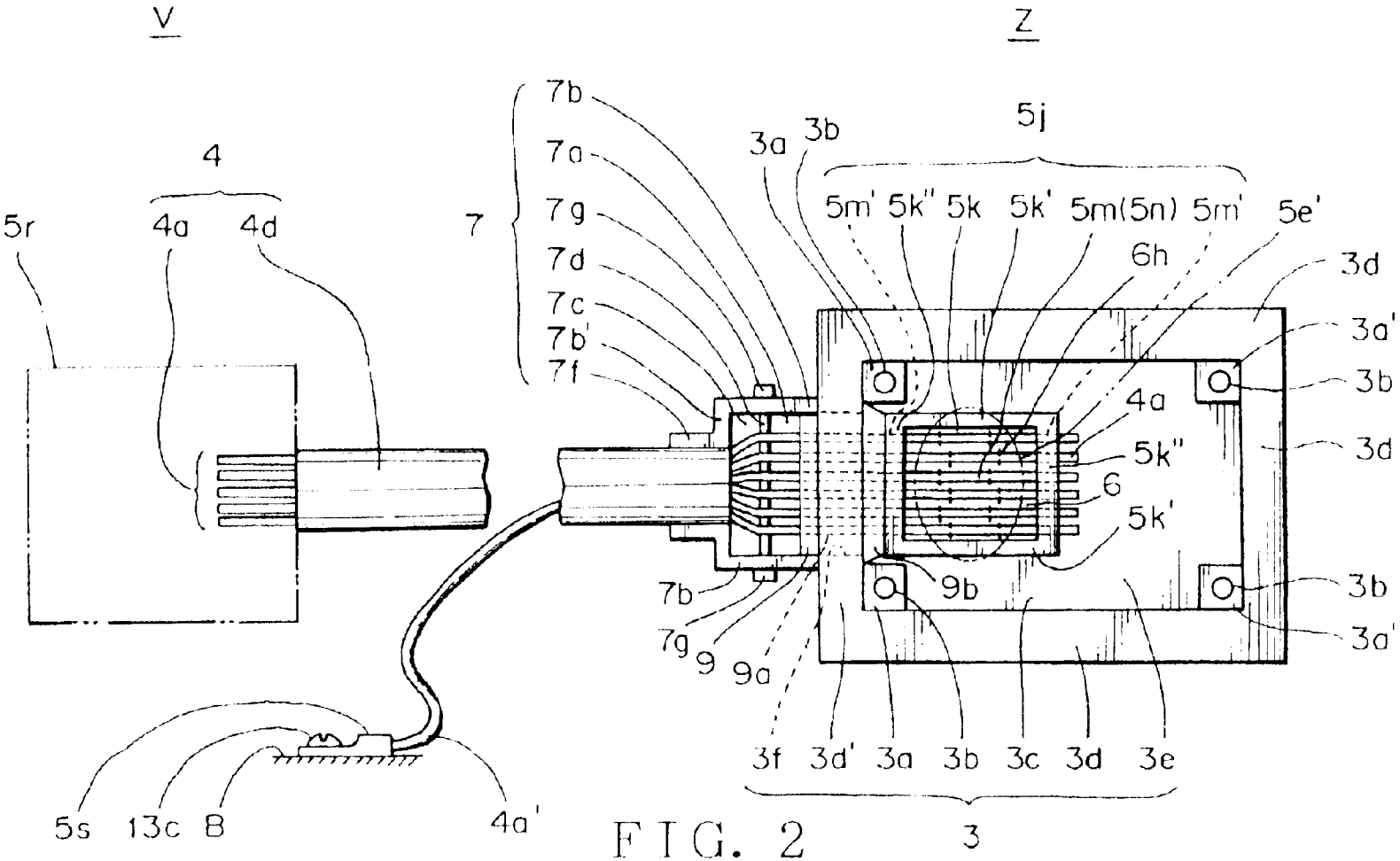
FIG. 2 is a conceptual drawing to show a top view of a case shown in FIG. 1 and connection of electric wires.
Figure 3:
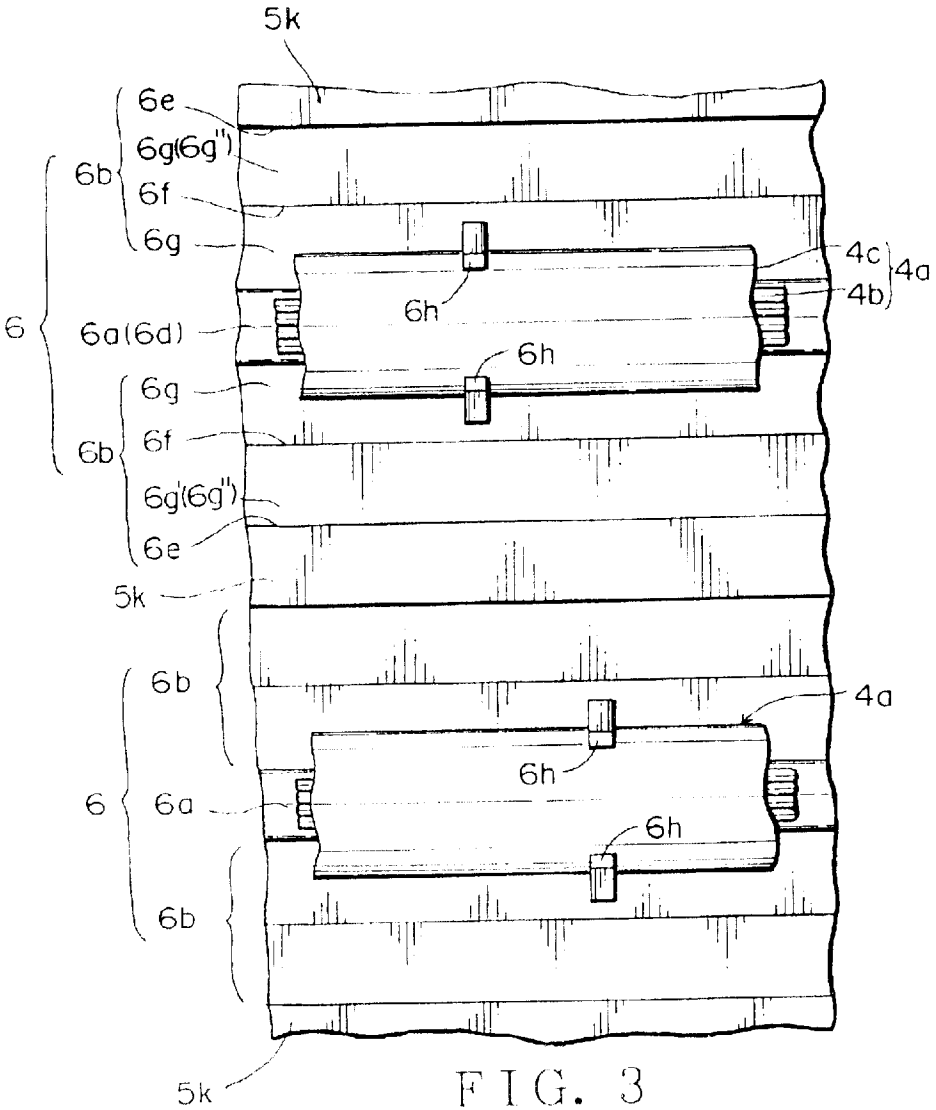
FIG. 3 is an expanded view of a pressure contact type connector shown in FIGS. 1 and 2.

FIG. 3 is an expanded conceptual drawing of a connecting portion 5*e*' in a surround area of a connector housing 5*j* formed in a receiving section 3*e* of a camera case 3 shown in FIGS. 1 and 2. Describing specifically, FIG. 3 is an expanded conceptual drawing of a inside of the connecting portion 5*e*' shown in a top view of the camera case 3 in FIG. 2.

FIG. 1 shows a condition of mounting a camera module Y, formed with a camera 1 including CCD with a base board 2, and a connecting case cover 8 on a specific position of the camera case 3. The camera module Z, as shown in FIG. 1, is provided at least with a camera 1 including CCD, a base board 2 having the camera 1 and a terminals 5*e*, i.e. a camera module Y and a camera case 3 for mounting the camera module Y including the base board 2 with the camera 1 thereto.

Putting the base board 2 into the camera case 3 along mount direction S1, the terminal 5*e* on the base board 2 and a connecting portion 5*e*' in the camera case 3 form a connector 5 and the terminal 5*e* and the connecting portion 5*e*' are electrically connected. The connector 5, as shown in FIG. 1–3, is provided juxtapositionaly in parallel and at even intervals in the connecting portion 5*e*' with positioning portions 6 corresponding to the terminal 5*e*.

Thereby, the camera 1, the base board 2 and the camera case 3 are modularized and then number of related elements can be reduced and miniaturization, weight saving and structural simplification of the module can be done. Furthermore, mounting the base board 2 provided with the camera 1 and the terminal 5*e* on the camera case 3 can perform assembling operation and electrically connecting operation simultaneously.

Figure 21:
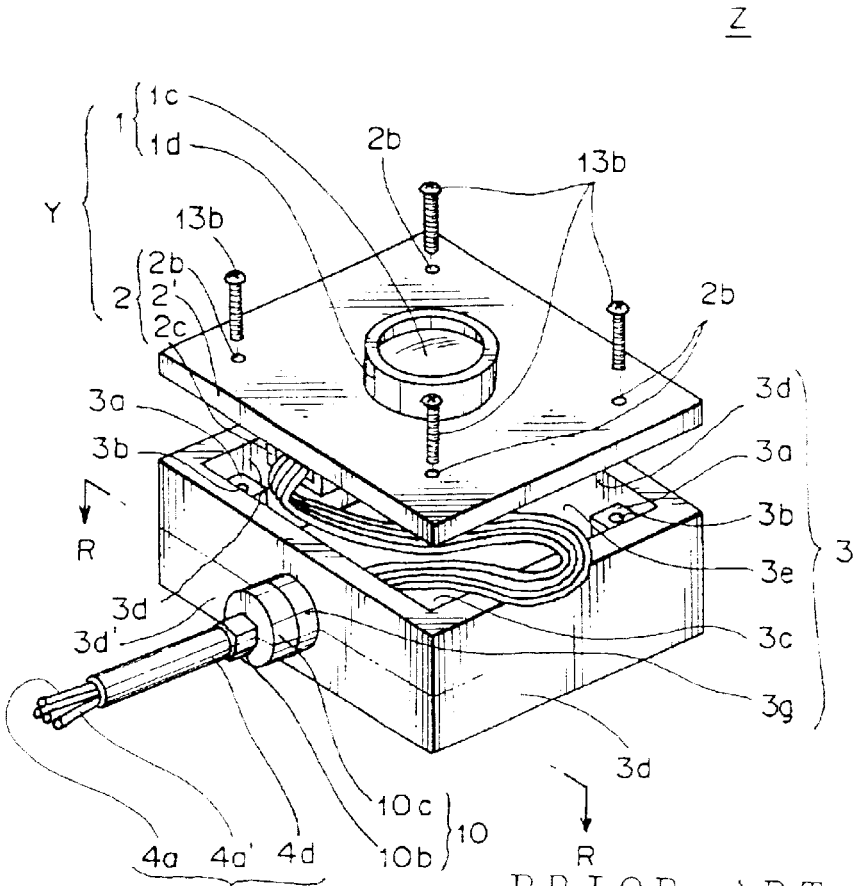
PRIOR ART FIG. 21
FIG. 21 is a perspective views, showing a trouble condition when fitting a camera module in a camera case by prior art.

Defective units concerned while assembling a camera module Z by prior art, shown in FIG. 21, can be eliminated. According to prior art, during mounting a base board 2 including a camera 1 on a camera case 3, it is feared that a cable 4*a* and a drain wire 4*a*' are bitten by the base board 2 and the camera case 3 and such camera module Z with bitten electric wire is judged as a defective unit by concerning open circuit in the inside of the cable 4*a* and the drain wire 4*a'*.

Abandoning such unfinished products is undesirable for terrestrial environment and wasteful on manufacturing. Then, reassembling a camera module Z to replace the wire harness 4 formed with the cable 4*a*, the drain wire 4*a*' and a tube 4*d*, a clamp 10 and other elements related with an electric wire 4 is required. According to this invention, such defective units can be eliminated without such troublesome operations.

Since the connector 5 formed in the camera module Z, as shown in FIGS. 1 and 3, is provided juxtapositionaly in parallel and at even intervals in the connecting portion 5*e*' with positioning portions 6 for connecting satisfactorily the terminals 5*e* with the connecting portion 5*e*', the terminals 5*e* is received accurately to the connecting portion 5*e*', shown in FIG. 2, when mounting the base board 2 including the terminals 5*e* on the camera case 3. Thereby, electrical connection can be done easily and securely.

Thus, operators are not required to pay over attention on a connector 5 when assembling a camera module Z and connecting of a connector 5 assembled by automatic assembling machines is satisfactory. Therefore, speed-up and enhancement on assembling operation can be done and then, a low cost and low percent defective camera module Z can be provided.

Describing minutely respective portion, shown in FIG. 1, the camera 1 is provided with a camera body 1' including CCD, a screw fixing portion 1*a*, a screw through hole 1*b*, a lens 1*c*, a lens area portion 1*d* and an other area including positioning holes 1*e*. Each positioning hole 1*e* on the camera body 1' is provided on each four corner of the camera body 1' to position precisely and fix the camera body 1' and a base board body 2'. Four positioning projections corresponding to each positioning hole 1*e* are provided on a bottom surface of the base board body 2', as shown in FIG. 1.

The base board 2 is provided on a bottom surface with the pressure contact type connector 5*a* having the connector housing 5*b* and the pressure contact type terminals 5*e*. The connector housing 5*b* is formed with a top wall 5*c* and a pair of guide portions 5*d* provided on the both side ends of the top wall 5*c*. A pressure contact type connector 5*a* is mounted on a required position of the base board body 2' to form into a part of the base board 2.

Figure 15:
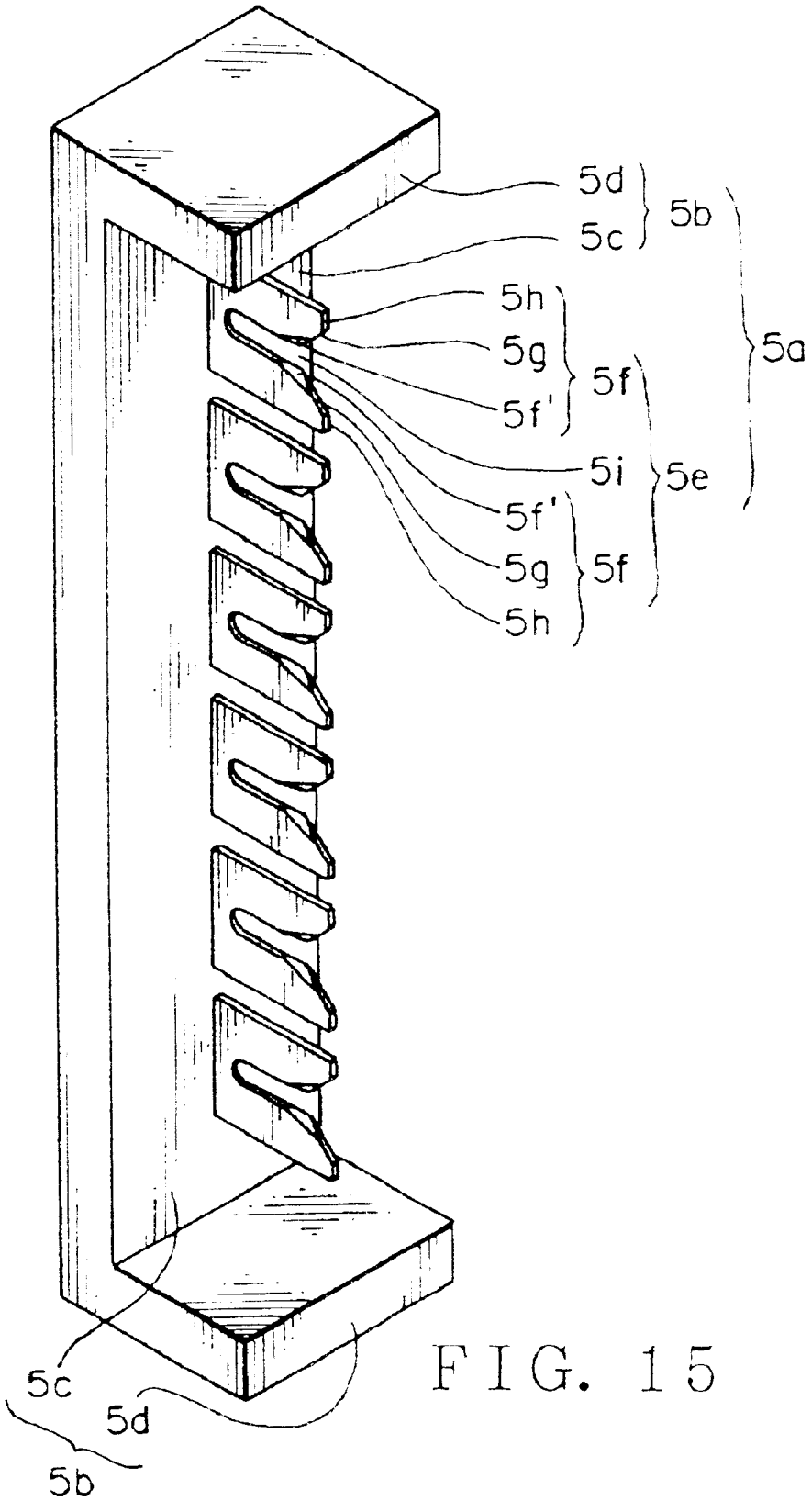
FIG. 15 is an expanded perspective view of other example of a pressure contact type connector shown in FIG. 1.

A shape of the pressure contact type terminal and assembling process for connecting the pressure contact type terminal with the cables 4*a*, 4*a*' will be described with reference to FIGS. 15-18. FIG. 15 is an expanded perspective view of the pressure contact type connector 5*a* shown in FIG. 1. The pressure contact type connector 5*a* is provided mainly with the pressure contact type terminals 5*e* having the pressure contact blade 5*f* and the connector housing 5*b*. The pressure contact type connector 5*a* is integrated into the base board 2 and the pressure contact type terminals 5*e* are connected with various circuits on the base board body 2'.

Six pressure contact type terminals 5*e* are provided in parallel and at even intervals and in a row on the top wall 5*c* of the pressure contact type connector 5*a*. A guide portion 5*d* of the connector housing 5*b* is for a guide when the pressure contact type connector 5*a* is assembled with the connector housing 5*j* provided in the receiving section 3*e* of the camera case 3.

Figure 16:
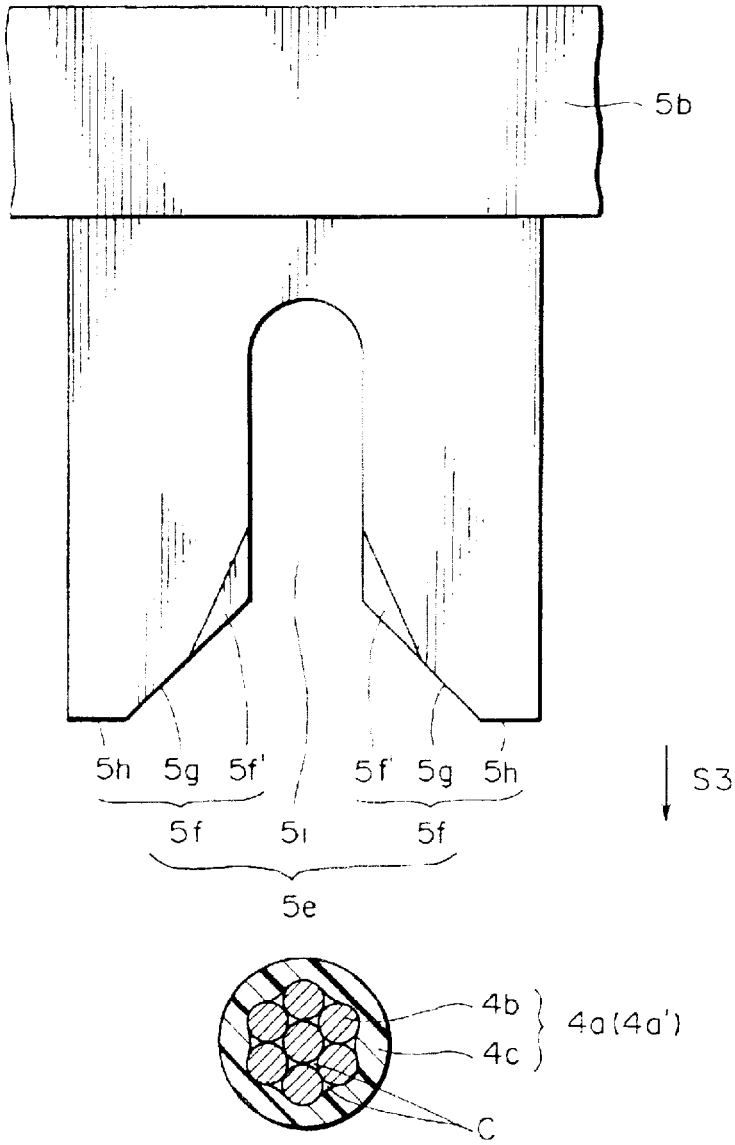
FIG. 16 is an expanded view, showing starting process for connecting the pressure contact type terminal with the cable, shown in FIG. 15.
Figure 18:
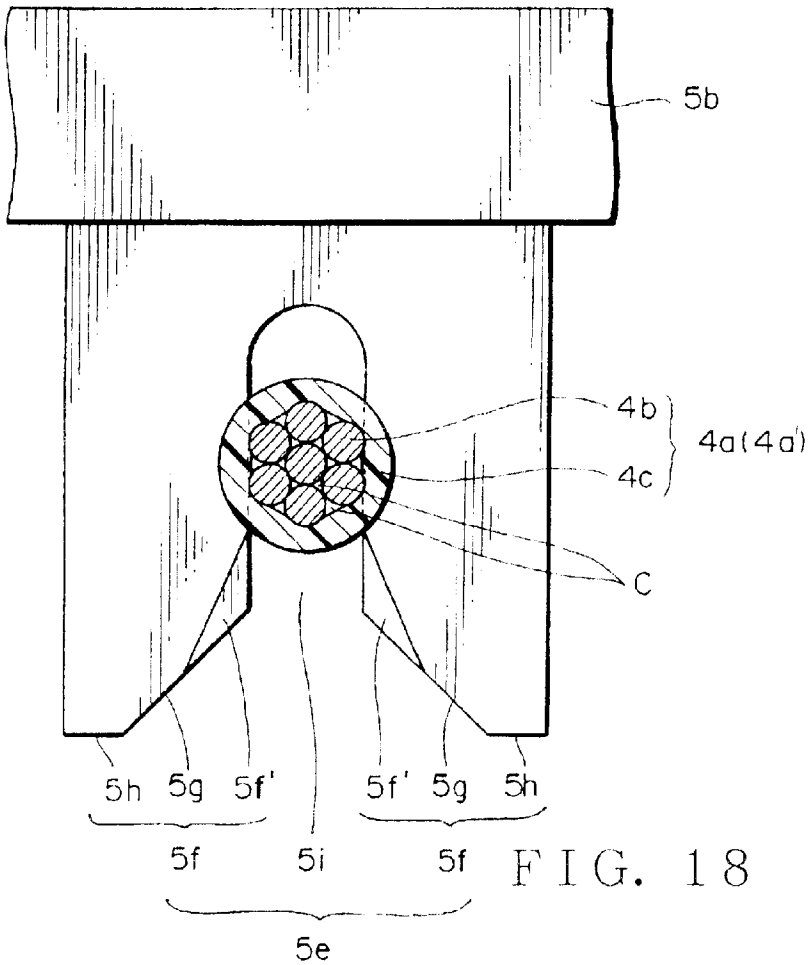
FIG. 18 is an expanded view, showing finished condition for connecting the pressure contact type terminal with the cable, shown in FIG. 17.
Figure 17:
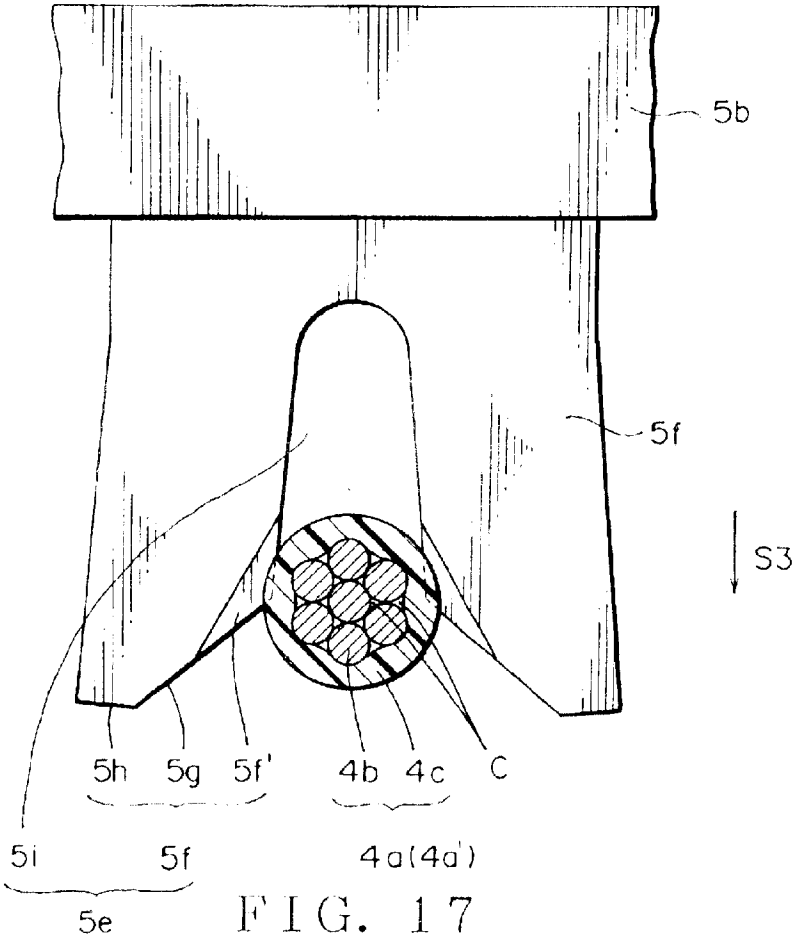
FIG. 17 is an expanded view, showing process after starting for connecting the pressure contact type terminal with the cable, shown in FIG. 16.

FIG. 16 is an expanded view, showing starting process for connecting the pressure contact type terminal 5*e* of the pressure contact type connector 5*a* shown in FIG. 15 with the cable 4*a*, 4*a*'. FIG. 17 is an expanded view, showing process after starting for connecting the pressure contact type terminal 5*e* with the cable 4*a*, 4*a*' shown in FIG. 16, along a mounting direction S3. FIG. 18 is an expanded view, showing finished condition for connecting the pressure contact type terminal 5*e* with the cable 4*a*, 4*a*' shown in FIG. 17.

Describing a shape of the pressure contact type terminal Se with reference to FIGS. 15 and 16, two slant portions 5*g* are formed to face each other and two pressure contact blades 5*f* are aligned in parallel to form the pressure contact type terminal 5*e*. The pressure contact blade 5*f* is formed in an opening area of inserting cables 4*a*, 4*a*' with a pair of slant portions 5*g* provided with blade portions 5*f*' having oblique sharp-edged shape. The blade portion 5*f*' is formed to decrease gradually its thickness of the pressure contact type terminal 5*e*.

The pressure contact type terminal 5*e* is formed in the center area with the pressure contact slit 5*i* dimensioned narrower than diameters of the cables 4*a*, 4*a*' to receive the conductive wires 4*b* of the cables 4*a*, 4*a*' and wider not to dig into the bundled conductive wires 4*b* over requirement or cut a circuit. The pressure contact slit 5*i* is formed into U-shape. The shape of the pressure contact type terminal as mentioned above is a general shape. However, in this invention, other shape may be effective.

The pressure contact type terminal 5*e* is formed with an edge portion 5*h* to prevent an operator hand hurt by a sharp edge of the pressure contact slit 5*f* when assembling the camera module Y by combining the camera 1 and the base board 2 or fitting the camera module Y into the camera case 3. However, the edge portion 5*h* may be formed into sharp edge shape depending on pressure contact terminal size or shape or place in use.

The pressure contact type terminal 5*e* is used to connect electrically with the conductive wire 4*b* as a core wire protected with the insulation cover 4*c* made of resin, rubber, mixture with them or enamel. Pressure contacting the cables 4*a*, 4*a*', formed with a plurality of conductive wires 4*b* protected with the insulation cover 4*c*, with the pressure contact type terminal 5*e*, shearing the insulation cover 4*c* and contacting the conductive wire 4*b* are done simultaneously.

The cables 4*a*, 4*a*', as shown in FIGS. 16–18, are formed with a plurality of conductive wires 4*b* having small gaps C between them and insulation covers 4*c*. Soft resin or rubber may be used for materials for the insulation cover 4*c* or the tube 4*d* of the electric wire 4 such as cables 4*a*, 4*a*', shown in FIGS. 1, 2, 16–18, used in this invention. The electric wire 4 such as a wire harness 4 is provided with the cables 4*a*, 4*a*', formed with conductive wires 4*b* and insulation cover 4*c*, and the tube 4*d*. The electric wire 4 is bent at any required position in use.

Therefore, a metallic wire having good conductivity and durability for repeat bending is preferable for conducting wire 4*b* material. In this invention, the core wire made of bundled and temperately twisted plural conductive wires 4*b* is good on strength. For improving surface insulation of the conductive wires 4*b* made with metallic wires, enamel coated conductive wires 4*b* may be used for the electric wire 4 such as the wire harness 4.

Insulation material having durability for repeat bending, as mentioned above, is preferable for insulation cover 4*c* to protect the conductive wire 4*b*. For such material, synthetic resin, soft resin, rubber or mixture with them may be used for the insulation cover 4*c* of the electric wire 4 such as the harness 4.

Describing minutely action of pressure contact connecting the conductive wire 4*b* through the pressure contact blade 5*f* of pressure contact type terminal 5*e*, shown in FIG. 16, to the pressure contact slit 5*i* of the pressure contact type terminal 5*e* with reference to FIGS. 17 and 18. Pressure contact connecting starts to press the pressure contact type terminal 5*e* down to the cables 4*a*, 4*a*' along a mounting direction S3, as shown in FIG. 16. Describing specifically, pressure contact connecting starts to arrange surfaces of a pair of the pressure contact blades 5*f* forming into the pressure contact type terminal 5*e* perpendicularly to an extending direction of electric wires 4*a*, 4*a*', i.e. the length direction of electric wires 4*a*, 4*a*' such as the cables 4*a*, 4*a*'.

The pressure contact blades 5*f* formed on the pressure contact terminal 5*e* starts to press the cables 4*a*, 4*a*' protected with the insulation cover 4*c*. The insulation cover 4*c*, made of resin or rubber or the like, of the cables 4*a*, 4*a*' and the insulation cover 4*c*, made of enamel, coated with thin thickness around the conductive wire 4*b* are sheared by sharp slant portions 5*g* i.e. blade portion 5*f*' of the pressure contact type terminal 5*e*. In the process, a pair of the pressure contact blades 5*f* forming into the pressure contact type terminal 5*e* are extended outwardly and the pressure contact slit 5*i* is slightly spread.

Pressing the terminal more, the pressure contact slit 5*i*, formed in the center area of the pressure contact type terminal 5*e*, contacts with the internal conductive wire 4*b* of the cables 4*a*, 4*a*', shearing more the insulation cover 4*c*, as shown in FIG. 18. Therefore, shearing the insulation cover 4*c* and contacting the conductive wire 4*b* are done simultaneously by the pressure contact type terminal 5*e*.

Thus, contacting the U-shape pressure contact slit 5*i*, provided with the pressure contact blade 5*f*, with the internal conductive wire 4*b* of the cables 4*a*, 4*a*' or the enamel coated conductive wire 4*b* can give electrically connecting condition. In other words, pressure contacting the pressure contact blade 5*f* of the pressure contact type terminal 5*e* with the conductive wire 4*b* of the cables 4*a*, 4*a*' or the enamel coated conductive wire 4*b* enables electrical connection.

Since operation of assembling the base board 2, mounted with the camera 1 and the pressure contact type connector 5*a*, i.e. the camera module Y and the camera case 3 and operation of pressure contact connecting as mentioned above can be done simultaneously, electrical connecting can be done by assembling the base board 2,provided with the camera 1 and the pressure contact type connector 5*a*, and the camera case 3.

When a pair of the pressure contact blades 5*f* is spread markedly more than the condition shown in FIG. 17, the pressure contact blades 5*f* of the pressure contact type terminals 5*e* are plastically deformed in spread condition and required pressure contact connection as shown in FIG. 18 may not be expected.

Preventing such failures, pressure contact blade receiving grooves 6*b* having corners edge 6*e* are provided on a bottom wall 5*k* of the connector housing 5*j*, as shown in FIGS. 6–8, 10–14, to guide the pressure contact blades 5*f* of the pressure contact type terminals 5*e*. Shapes of the pressure contact blade receiving grooves 6*b* or the positioning portions 6 for electric wire setting portion 6*a* or the pressure contact type terminals 5*e* corresponding to the pressure contact blade receiving grooves 6*b* and a process of connecting the pressure contact type terminals 5*e* and the cables 4*a*, 4*a*' will be described with reference to FIGS. 5–14.

Figure 5:
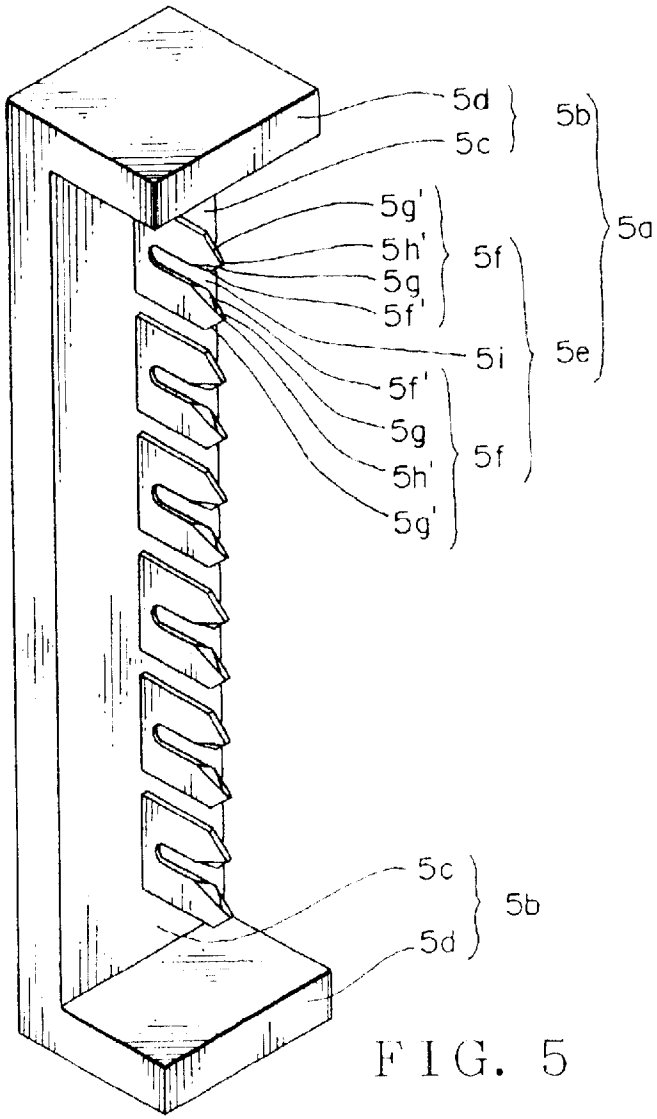
FIG. 5 is a partial expanded perspective view of a pressure contact type connector shown in FIG. 1.

FIG. 5 is an expanded perspective view of a pressure contact type connector 5*a* mounted on the base board 2 having the camera 1 i.e. the camera module Y shown in FIG. 1. Description on the shape of the pressure contact type connector 5*a* is almost same as description mentioned above in FIG. 15 and then omitted herein.

Figure 6:
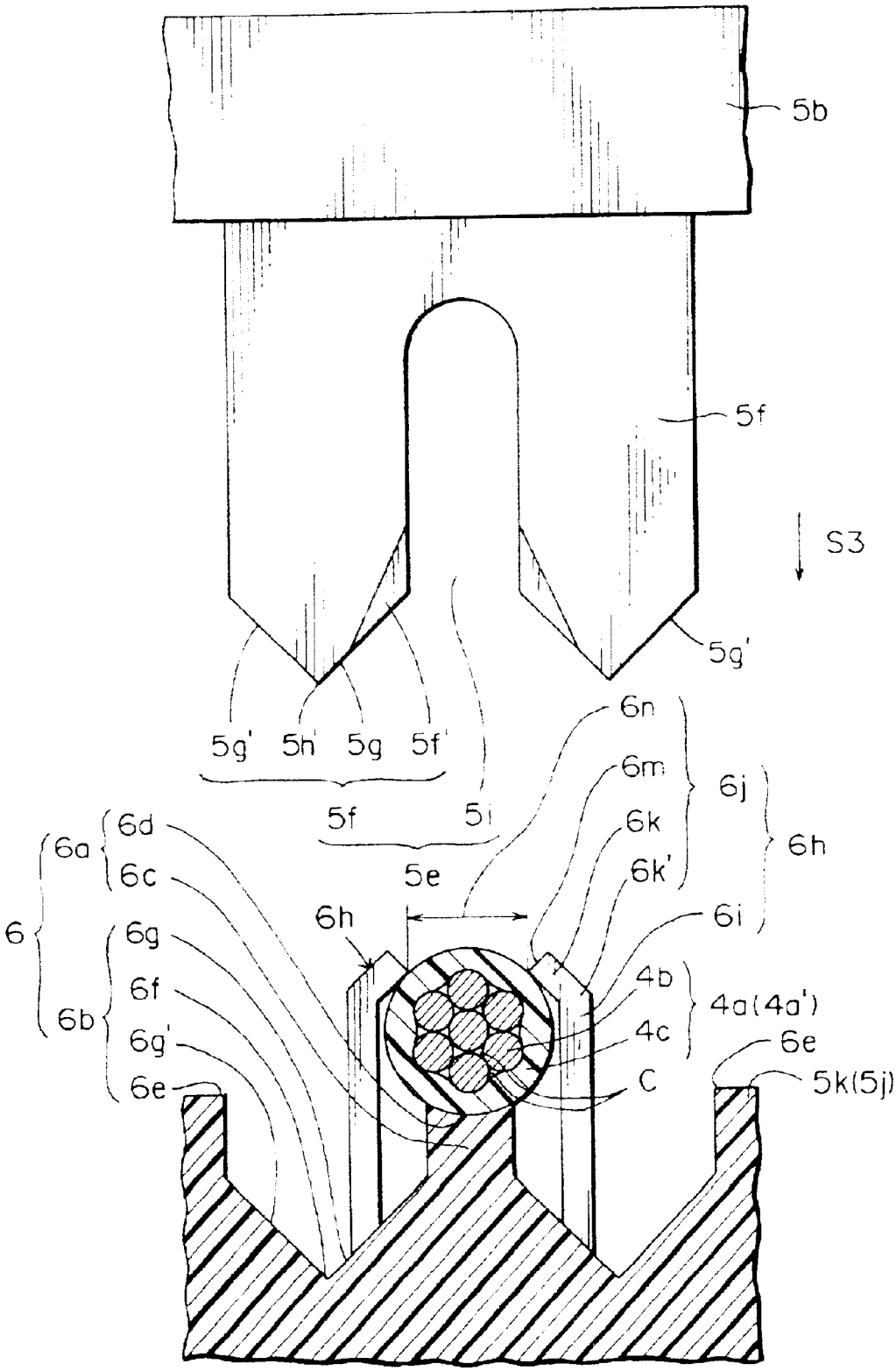
FIG. 6 is an expanded view, showing starting process for connecting the pressure contact type terminal with the cable shown in FIGS. 1–3 and 5.
Figure 8:
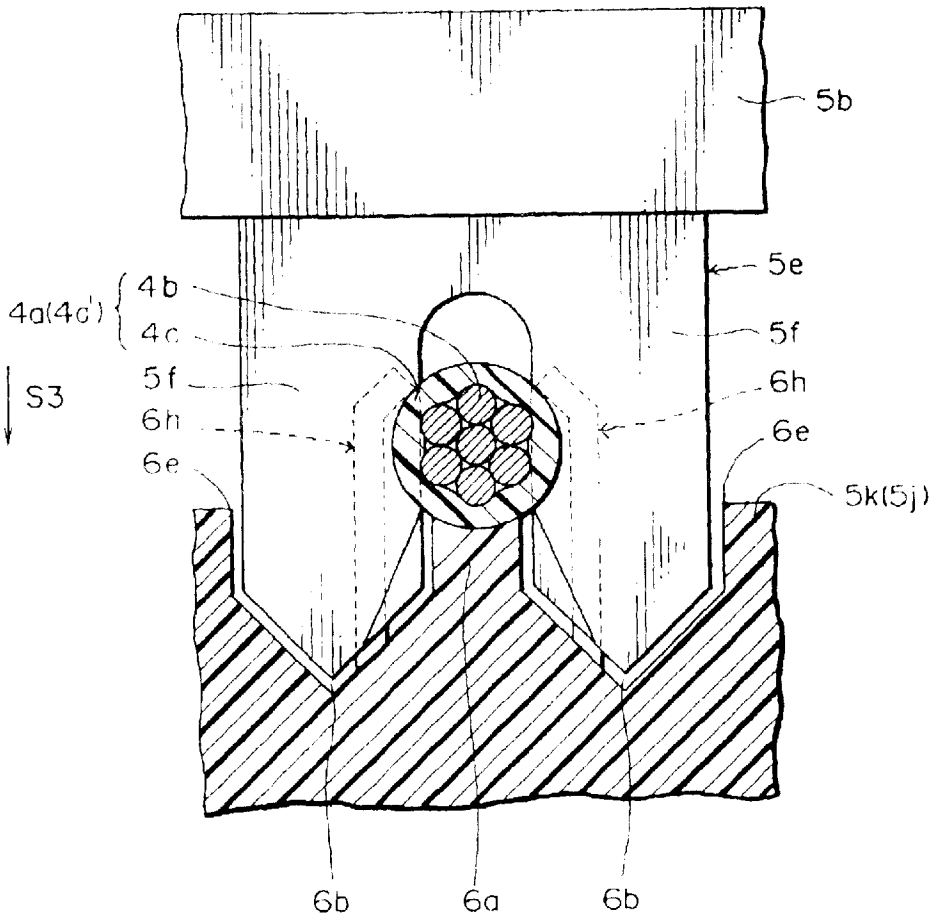
FIG. 8 is an expanded view, showing finished condition for connecting the pressure contact type terminal with the cable shown in FIG. 7.
Figure 7:
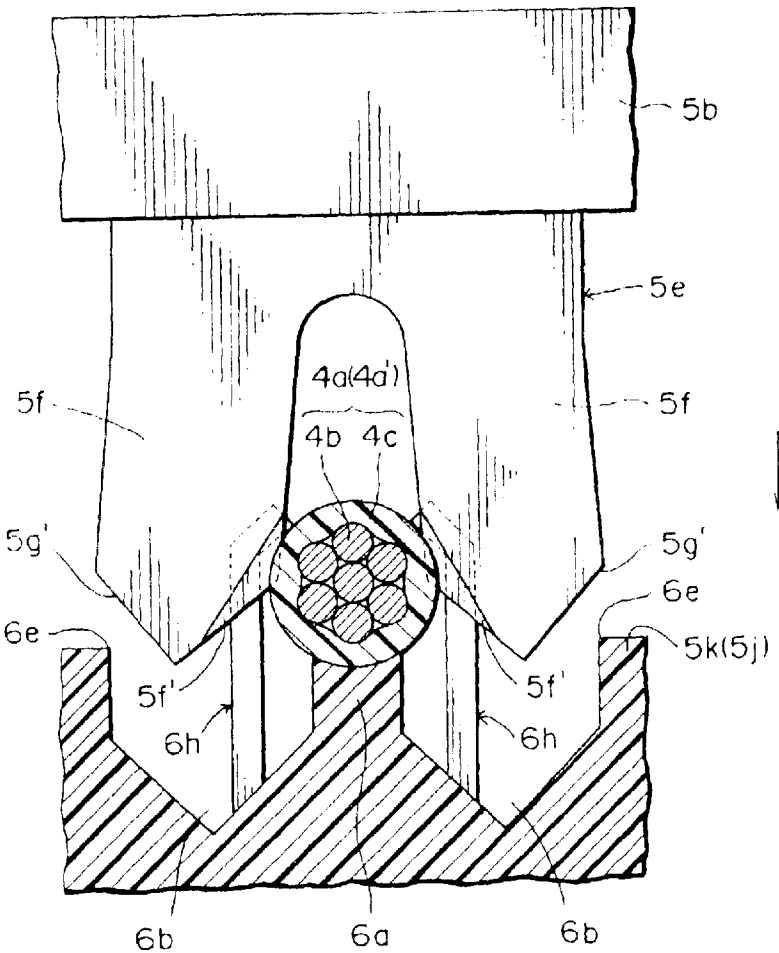
FIG. 7 is an expanded view, showing process after starting for connecting the pressure contact type terminal with the cable shown in FIG. 6.

FIG. 6 is an expanded view, showing starting process for connecting the pressure contact type terminals 5*e* with the cable 4*a*, 4*a*' shown in FIGS. 1–3 and 5. FIG. 7 is an expanded view, showing process after starting connection of the pressure contact type terminal 5*e* and the cable 4*a*, 4*a*' along a mounting direction S3 shown in FIG. 6. FIG. 8 is an expanded view, showing finished condition of connecting the pressure contact type terminal 5*e* with the cable 4*a*, shown in FIG. 7.

A shape of the pressure contact type terminal 5*e* shown in FIGS. 5–8 and action of connecting the pressure contact type terminal 5*e* with the cables 4*a*, 4*a*' are almost same as description mentioned above in FIGS. 15–18 and then detailed description on common area will be omitted herein. Differences between the pressure contact type terminals 5*e* shown in FIGS. 15, 16 and the terminals 5*e* shown in FIGS. 5, 6 will be described as following.

The pressure contact type terminal 5*e* is formed with a pair of pressure contact blades 5*f* and a pressure contact slit 5*i* located between a pair of the pressure contact blades 5*f*. The pressure contact blades 5*f* includes two slant portions 5*g*, 5*g*', top portions 5*h*' formed by the two slant portions 5*g*, 5*g*' and blade portions 5*f*' formed on the slant portions 5*g* in a side of the pressure contact slit 5*i*.

The pressure contact type terminal 5*e* is provided with the slant portions 5*g* for leading easily the cables 4*a*, 4*a*' into the pressure contact slit 5*i* of the pressure contact type terminal 5*e*. Other pair of the slant portions 5*g*' are provided outside a pair of the slant portions 5*g*. Other pair of the slant portions 5*g*' are formed to taper off from an outside of the pressure contact type terminal 5*e*. Thus, top edges of the top portions 5*h*' of the pressure contact type terminal 5*e* are formed into V-shape.

The slant portions 5*g*' are formed to have opposite directions against the direction of the slant portions 5*g* formed on the pressure contact slit 5*i* of the pressure contact type terminal 5*e* to lead the cables 4*a*, 4*a*'. Thus, the top portions 5*h*' are formed on the pressure contact blades 5*f* of the pressure contact type terminal 5*e* by respective pair of the slant portions 5*g*, 5*g*'. Forming a pair of the slant portions 5*g*' outside the pressure contact type terminal 5*e* to be narrower, a pair of the pressure contact blades 5*f* of the pressure contact type terminal 5*e* is received into the pressure contact blade receiving groove 6*b* through the corners edges 6*e* of a pair of the pressure contact blade receiving grooves when connecting.

The positioning portion 6 is formed with the electric wire setting portions 6*a* provided on the bottom wall 5*k* of the connector housing as shown in FIGS. 3, 6 and a pair of the pressure contact blades 6*b* provided at divided positions on the center of the electric wire setting portion 6*a*. The pressure contact blade receiving groove 6*b* is formed into a similar shape to the outline of the top portions 5*h*' of the corresponding pressure contact type terminal 5*e*, as shown in FIG. 6. Forming the pressure contact blade receiving groove 6*b* into a similar shape to the outline of the top portions 5*h*' of the pressure contact type terminal 5*e*, the pressure contact type terminal 5*e* is received satisfactory into the pressure contact blade receiving groove 6*b* with no positioning error when connecting.

The electric wire setting portion 6*a*, as shown in FIG. 6, is provided with a pillar portion 6*c* and a supporting portion 6*d*. The supporting portion is formed into in-curved shape correspondingly to an outer surface of the cables 4*a*, 4*a*' to mount the cables 4*a*, 4*a*'. The in-curved surface has almost same radius of curvature as the cables 4*a*, 4*a*'. The cables 4*a*, 4*a*' formed with a plural of the conductive wires 4*a*, protected with the insulation cover 4*c*, are mounted on the supporting portions 6*d* with in-curved surface.

The pressure contact blade receiving groove 6*b*, as shown in FIGS. 3 and 6, is formed with corner edges 6*e*, a groove bottom portion 6*f* and slant portions 6*g*, 6*g*'. The pressure contact blade groove 6*b* will be described minutely with reference to FIG. 6. The pressure contact blade receiving groove 6*b* is provided with a vertical surface going down through the corner edge 6*e* from the surface of the bottom wall 5*k* of the connector housing, a side wall of the pillar portion 6*c* of the electric wire setting portion 6*a* parallel to the vertical surface, two slant portions 6*g*, 6*g*' formed into V-shape slanting from the vertical surface and the side surface of the pillar portion 6*c* and the groove bottom portion 6*f* joined by these two slant portions 6*g*, 6*g*'.

A flat surface chamfer or a round surface fillet can be applied preferably on the corner edge 6*e* of the pressure contact blade receiving groove 6*b*. A pair of the pressure contact blade receiving grooves 6*b* are provided with a pair of a wire fixing portion 6*h* to fix the cables 4*a*, 4*a*', as shown in FIGS. 3 and 6. The wire fixing portions 6*h*, as shown in FIG. 3, are located in a stagger for adjacent cables 4*a*, 4*a*' of each other.

When connecting the pressure contact type terminal 5*e* with the cable 4*a*, 4*a*', a pair of the slant portions 5*g*' abut on the corner edges 6*e* of a pair of the pressure contact blade receiving grooves 6*b* and push inwardly a pair of the pressure contact blades 5*f* of the pressure contact type terminal 5*e*, as shown in FIGS. 6–8. Thereby, pressure contact connection of the pressure contact type terminal 5*e* and the cables 4*a*, 4*a*' can be done securely.

Figure 9:
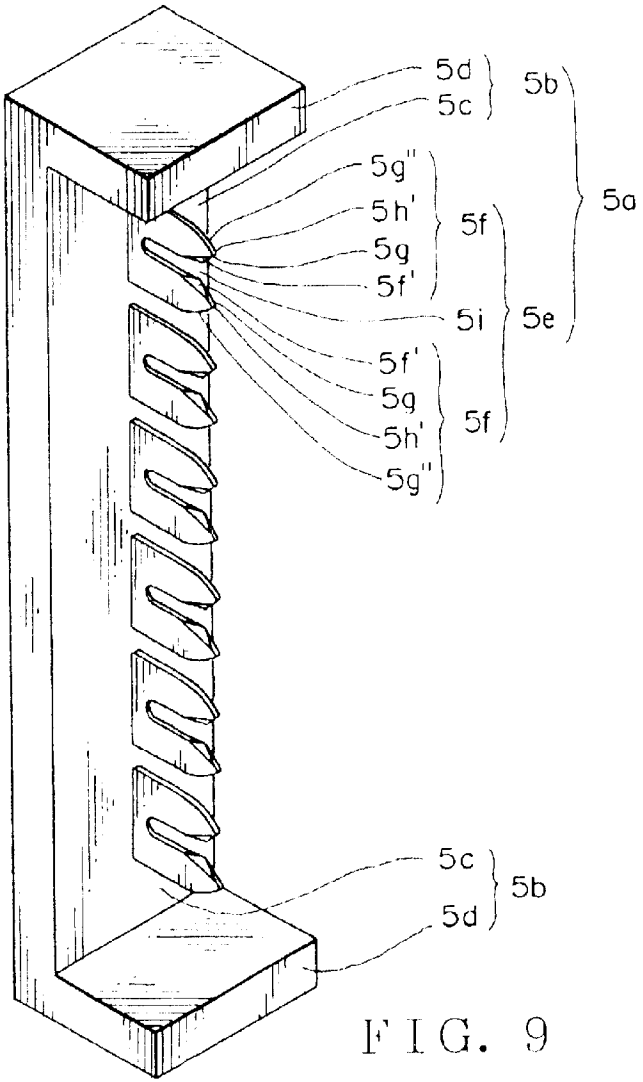
FIG. 9 is an expanded perspective view of other example of a pressure contact type connector shown in FIG. 1.

FIG. 9 is an expanded perspective view of other embodiment of a pressure contact connector 5*a* mounted on the base board 2 provided with the camera 1 i.e. the camera module Y shown in FIG. 1. The shape of the pressure contact connector 5*a* is the same as mentioned above in FIG. 15 and then detailed description is omitted here.

Figure 10:
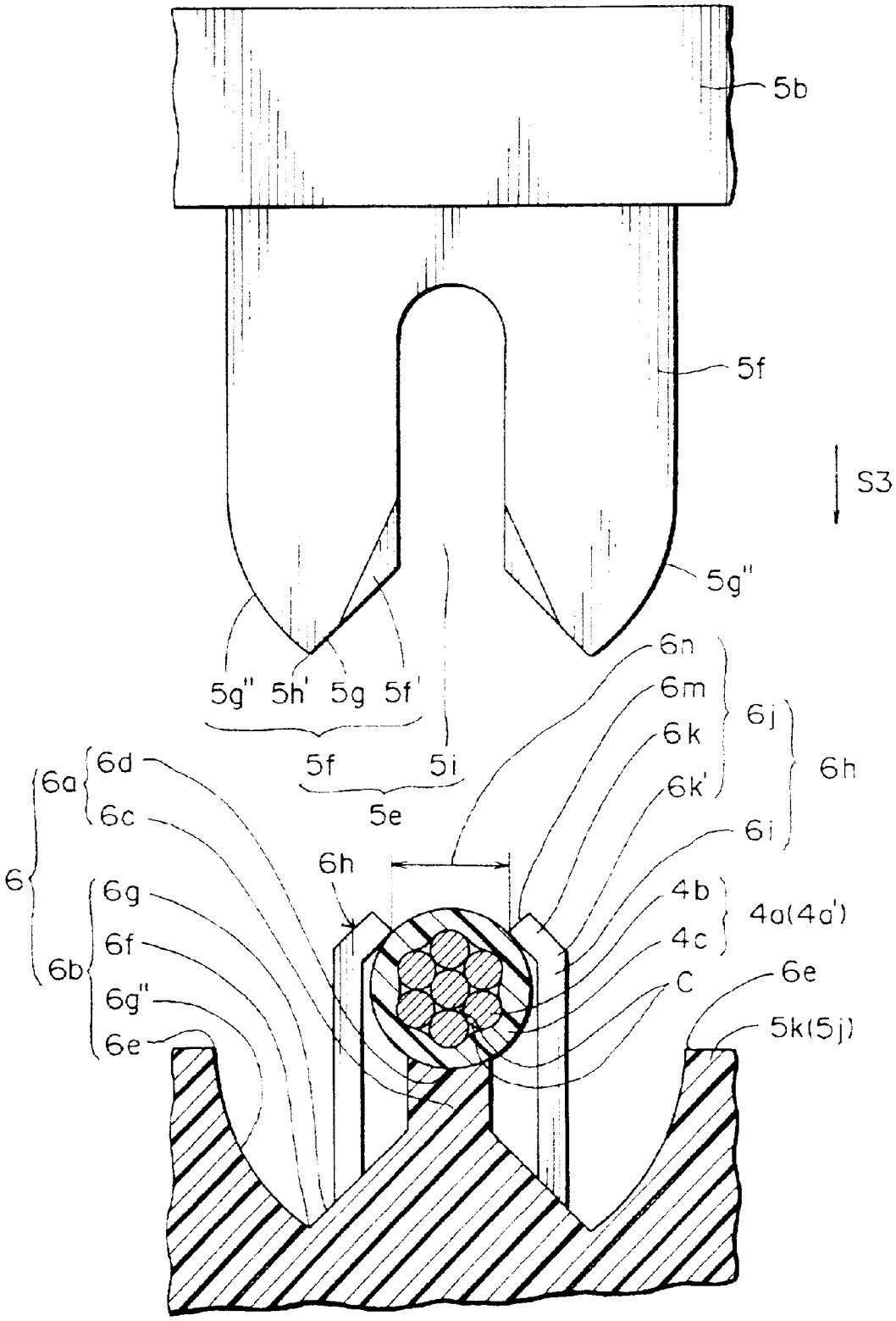
FIG. 10 is an expanded view, showing starting process for connecting the pressure contact type terminal with the cable shown in FIGS. 1–3 and 9.
Figure 12:
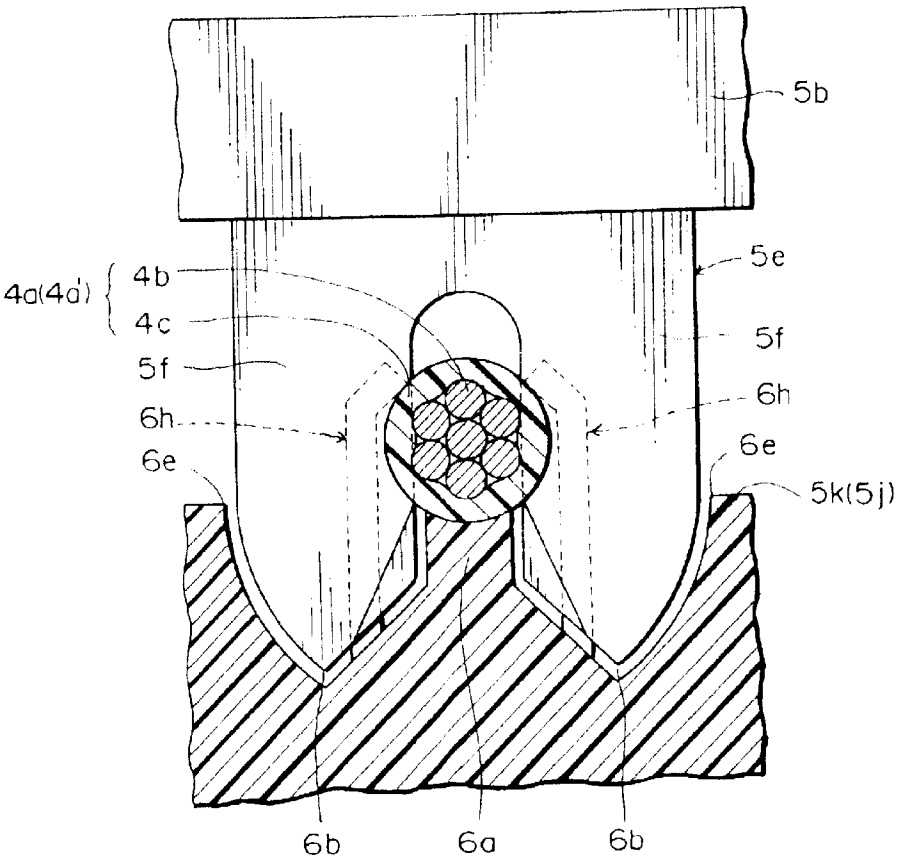
FIG. 12 is an expanded view, showing finished condition for connecting the pressure contact type terminal with the cable shown in FIG. 11.
Figure 11:
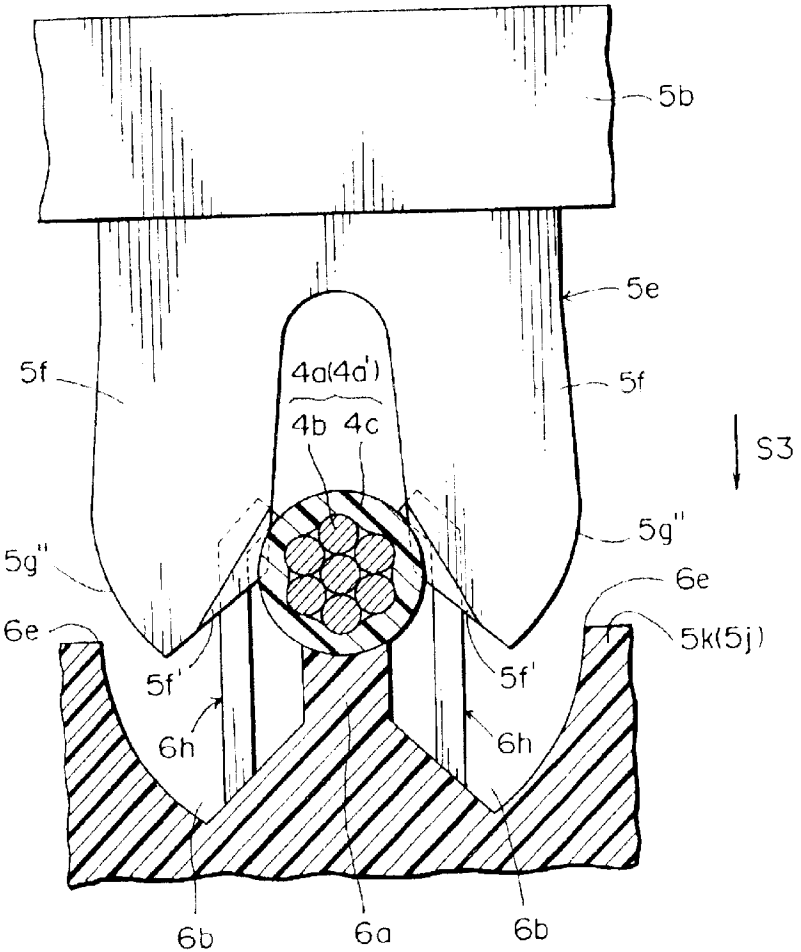
FIG. 11 an expanded view, showing process after starting for connecting the pressure contact type terminal with the cable shown in FIG. 10.

FIG. 10 is an expanded view, showing starting process for connecting the pressure contact type terminal 5*e* with the cable 4*a*, shown in FIGS. 1, 2, 3, 9. FIG. 11 is an expanded view, showing process after starting for connecting the pressure contact type terminal 5*e* with the cable 4*a*, shown in FIG. 10,along a mounting direction S3. FIG. 12 is an expanded view, showing finished condition for connecting the pressure contact type terminal 5*e* with the cable 4*a*, shown in FIG. 11.

Description on a shape of the pressure contact type terminal 5*e* shown in FIGS. 9–12 and an action of connecting the pressure contact type terminal 5*e* and the cables 4*a*, 4*a*' is almost same as mentioned above in FIGS. 5–8, 15–18, and description on common matters is omitted herein. A point of difference between the pressure contact type terminal 5*e* shown in FIGS. 1, 6, 15, 16 and the pressure contact type terminal 5*e* shown in FIGS. 9, 10 will be described.

The pressure contact type terminal 5*e*, as shown in FIGS. 9, 10, is formed with a pair of the pressure contact blades 5*f* and the pressure contact slit 5*i* located between a pair of the pressure contact blades 5*f*. The pressure contact blades 5*f* are formed with a pair of the slant portions 5*g* for leading the cables 4*a*, 4*a*' into the pressure contact slit 5*i*, arc portions 5*g*" formed by continuous curve to be narrowed inwardly from outside edges of the pressure contact type terminal 5*e*, top portions 5*h*' joined by the slant portions 5*g* and the arc portions 5*g*" and blade portions 5*f*' formed on the slant portions 5*g*.

The slant portions 5*g* are formed in a direction for leading easily the cables 4*a*, 4*a*' into the pressure contact slit 5*i* of the pressure contact type terminal 5*e*. On the other hand, the arc portions 5*g*" are formed into arc shape in an opposite direction against the slant portions 5*g*. Thus, top edges of the top portions 5*h*' of the pressure contact type terminal 5*e* are formed into V-shape. Forming a pair of the arc portions 5*g*" on the outside of the pressure contact type terminal 5*e*, a pair of the pressure contact blades 5*f* of the pressure contact type terminal 5*e* can be received satisfactorily into the pressure contact blade receiving grooves 6*b* through corner edges 6*e* of a pair of the pressure contact blade receiving grooves 6*b*, on connecting.

The positioning portion 6 is formed with the electric wire setting portion 6*a*, as shown in FIG. 10, provided on the bottom wall 5*k* of the connector housing and a pair of the pressure contact blade receiving grooves 6*b* provided at divided positions on the center of the electric wire setting portion 6*a*. The pressure contact blade receiving groove 6*b* is formed into similar shape to the outline shape of the top portion 5*h*' of corresponding pressure contact type terminal 5*e*. Forming the pressure contact blade receiving groove 6*b* into a similar shape to the outline of the top portions 5*h*' of the pressure contact type terminal 5*e*, the pressure contact type terminal 5*e* is received satisfactory into the pressure contact blade receiving groove 6*b* with no positioning error when connecting.

The shape of the electric wire setting portion 6*a* is the same as mentioned above in FIG. 6 and detailed description will be omitted here. The shape of the cables 4*a*, 4*a*' mounted on the electric wire setting portion 6*a* is also the same as mentioned above in FIGS. 6, 16–18 and detailed description will be omitted here.

The pressure contact blade receiving groove 6*b*, as shown in FIG. 10, is formed with corner edges 6*e*, a groove bottom portion 6*f*, a slant portion 6*g* and a arc portion 6*g*". Describing the pressure contact blade grooves 6*b* minutely, a pair of the pressure contact blade receiving grooves 6*b* are provided with a pair of arc portions 6*g*" formed narrowing downwardly through the corner edge 6*e* from the surface of the bottom wall 5*k* of the connector housing, side walls of the pillar portion 6*c*, perpendicular to the surface of the bottom wall 5*k* of the connector housing, of the electric wire setting portion 6*a*, a pair of slant portions 6*g* formed spreading downwardly from the bottom edge of the side surface of the pillar portion 6*c* and the groove bottom portions 6*f* joined by arc portions 6*g*" and slant portions 6*g*.

A flat surface chamfer or a round surface fillet can be applied preferably on the corner edge 6*e* of the pressure contact blade receiving groove 6*b*. A pair of the pressure contact blade receiving grooves 6*b* are provided with a pair of a wire fixing portion 6*h* to fix the cables 4*a*, 4*a*'.

When connecting the pressure contact type terminal 5*e* with the cable 4*a*, 4*a*', a pair of the arc portions 5*g*" formed on the pressure contact type terminal 5*e* abut on the corner edges 6*e* of a pair of the pressure contact blade receiving grooves 6*b* and push inwardly a pair of the pressure contact blades 5*f* of the pressure contact type terminal 5*e*, as shown in FIGS. 10–12. Thereby, pressure contact connection of the pressure contact type terminal 5*e* and the cables 4*a*, 4*a*' can be done securely.

Figure 14:
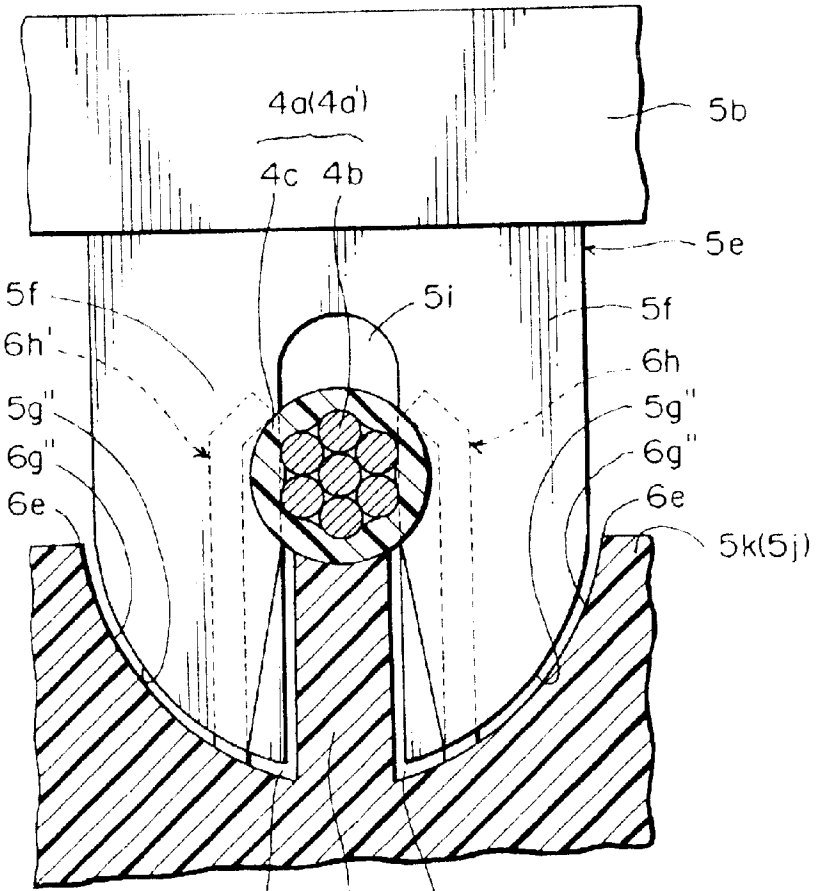
FIG. 14 is an explanatory drawing of other example of a pressure contact type terminal and a positioning portion shown in FIG. 10.
Figure 13:
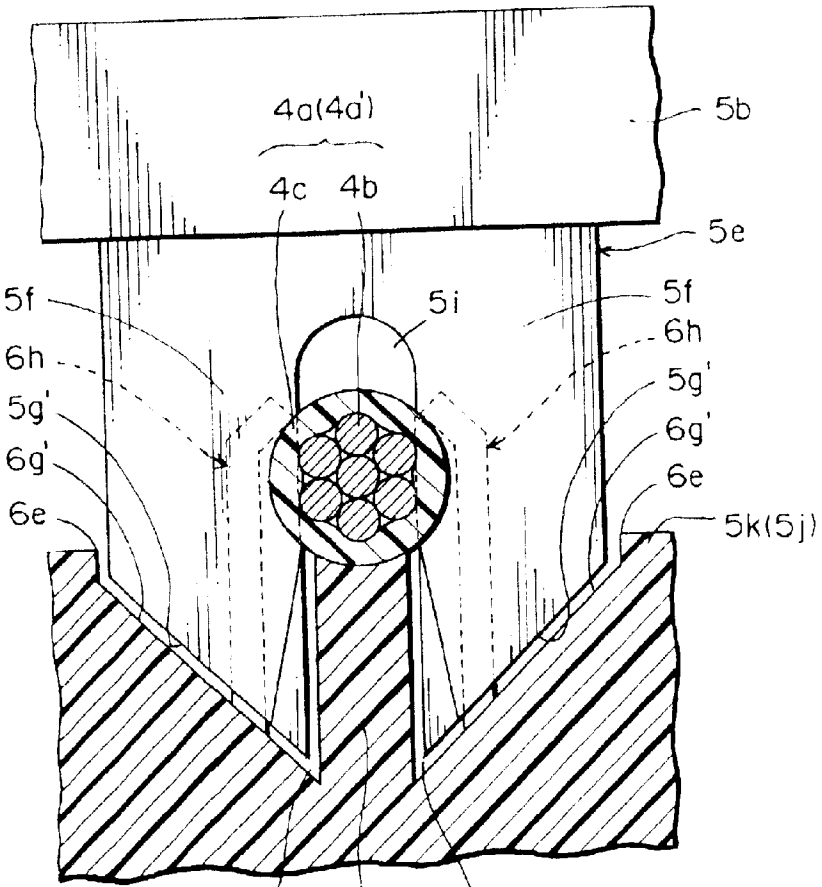
FIG. 13 is an explanatory drawing of other example of a pressure contact type terminal and a positioning portion shown in FIG. 6.

Not only the shape of the pressure contact type terminal 5*e* and the shape of the positioning portions provided with the electric wire setting portion 6*a* and the pressure contact blade receiving grooves 6*b* for positioning the cables 4*a*, 4*a*', as mentioned above, but also shapes shown in FIGS. 13, 14 can be used in this invention. FIG. 13 is a conceptual drawing, showing other embodiment of the pressure contact type terminal 5*e* and the positioning portion 6 shown in FIG. 6. FIG. 14 is a conceptual drawing, showing other embodiment of the pressure contact type terminal 5*e* and the positioning portion 6 shown in FIG. 10.

The pressure contact type terminal 5*e* and the positioning portion 6 shown in FIG. 6 and the terminal and the portion shown in FIG. 13 are almost same and differences between the pressure contact type terminals 5*e* and the positioning portion 6 shown in FIGS. 6 and 13 will be described mainly here. The pressure contact type terminal 5*e* shown in FIG. 13 is provided with a pair of the pressure contact blades 5*f* and the pressure contact slit 5*i* located between a pair of the pressure contact blades 5*f*. The pressure contact blades 5*f* includes a pair of the slant portions 5*g*' formed narrowing from an outside edge of the pressure contact type terminals 5*e* and blade portions formed at top edge area by the pressure contact slit 5*i* and the slant portions 5*g*'. The blade portion is formed into sharp edge shape on a bottom half area of the pressure contact slit 5*i* to decrease gradually its thickness of the pressure contact type terminal 5*e*.

The pressure contact blade receiving groove 6*b* is formed into a similar shape to the outline of the top portion of the corresponding pressure contact type terminal 5*e*. The pressure contact blade receiving groove 6*b* is formed with a corner edge 6*e*, a groove bottom portion, a slant portion 6*g*' and a side wall of the electric wire setting portion 6*a*. Describing the pressure contact blade groove 6*b* minutely, a pair of the pressure contact blade receiving grooves 6*b* are provided with vertical surfaces going down through the corner edges 6*e* from the surface of the bottom wall 5*k* of the connector housing, side walls of a pillar portion of the electric wire setting portion 6*a* parallel to the vertical surface, a pair of slant portions 6*g*' formed narrowing downwardly along a line from a bottom edge of the vertical surface to a bottom edge of the side wall of the electric wire setting portion 6*a* and the groove bottom portions joined by the slant portions 6*g*' and the bottom edges of the side surfaces of the pillar portion.

The pressure contact type terminal 5*e* and the positioning portion 6 shown in FIG. 10 and the terminal and the portion shown in FIG. 14 are almost same and differences between the pressure contact type terminals 5*e* and the positioning portion 6 shown in FIGS. 10 and 14 will be described mainly here. The pressure contact type terminal 5*e* shown in FIG. 14 is provided with a pair of the pressure contact blades 5*f* and the pressure contact slit 5*i* located between a pair of the pressure contact blades 5*f*. The pressure contact blades 5*f* includes a pair of the arc portions 5*g*" formed narrowing from an outside edge of the pressure contact type terminals 5*e* and blade portions formed at top edge area by the pressure contact slit 5*i* and the arc portions 5*g*". The blade portion is formed into sharp edge shape on a bottom half area of the pressure contact slit 5*i* to decrease gradually its thickness of the pressure contact type terminal 5*e*.

The pressure contact blade receiving groove 6*b* is formed into a similar shape to the outline of the top portion of the corresponding pressure contact type terminal 5*e*. The pressure contact blade receiving groove 6*b* is formed with a corner edge 6*e*, a groove bottom portion, an arc portion 6*g*" and a side wall of the electric wire setting portion 6*a*. Describing the pressure contact blade groove 6*b* minutely, a pair of the pressure contact blade receiving grooves 6*b* are provided with vertical surfaces going down through the corner edges 6*e* from the surface of the bottom wall 5*k* of the connector housing, side walls of a pillar portion of the electric wire setting portion 6*a* parallel to the vertical surfaces, a pair of arc portions 6*g*" formed narrowing downwardly from a bottom edge of the vertical surface to a bottom edge of the side wall of the electric wire setting portion 6*a* and the groove bottom portions joined by the arc portions 6*g*" and the bottom edges of the side surfaces of the pillar portion.

A pair of the pressure contact blade receiving grooves 6*b* are provided with a pair of a wire fixing portion 6*h* to fix the cables 4*a*, 4*a*' in FIGS. 13 and 14. A flat surface chamfer or a round surface fillet can be applied preferably on the corner edge 6*e* of the pressure contact blade receiving groove 6*b*.

The camera module Z shown in FIGS. 1 and 2 according to this invention will be described minutely with reference to FIGS. 5–14. The terminal 5*e* means the pressure contact type terminal 5*e* and the connecting portion 5*e*' is provided with the cable 4*a* and the drain wire 4*a*' and the base board 2 is provided with the pressure contact type connector 5*a* including the pressure contact type terminals 5*e*. The camera case 3 is provided, in a receiving section 5*m*, with the connector housing 5*j* including the cable 4*a* and the drain wire 4*a*' inside.

Fitting the base board 2 provided with the camera 1 and the pressure contact type connector 5*a* into the camera case 3, the cables 4*a* and the drain wire 4*a*' are connected by pressure contacting to form into the connector 5. The positioning portion 6, as shown in FIGS. 6 and 10, is provided with the electric wire setting portions 6*a* and the pressure contact blade receiving grooves 6*b*. Pressure contact connecting is done by guiding the pressure contact blades 5*f* of the pressure contact type terminal 5*e* into the pressure contact blade receiving grooves 6*b*. Thus, electrical connection can be done easily during assembling operation by pressure-contact connecting specifically with the pressure contact type terminals 5*e*.

Regarding an auxiliary device module by prior art, operation of connecting securely pressure contact type terminals 5*e* with electric wires 4*a*, 4*a*' requires to pay much attention. An auxiliary device module Z failed in continuity test after operating pressure contact connection must be treated as a defective product.

If pressure contact connection are applied again on the same position of electric wires 4*a*, 4*a*' which had be sheared once by pressure contact type terminals 5*e*, the second electrical disconnection on the positions is concerned. Therefore, electric wires 4*a*, 4*a*' applied pressure contact connection must be replaced or the other positions of the electric wires instead of the positions applied pressure contact connection previously must be connected with pressure contact type terminals.

However, in a module according to this invention, an auxiliary device module Z is provided in the positioning portion 6 with pressure contact blade receiving grooves 6*b* for guiding pressure contact type terminals 5*e* into the connector and then, when mounting a base board 2 mounted with the pressure contact type terminals 5*e* on a camera case 3, electrical connection can be done by guiding securely the pressure contact type terminals 5*e* on the electric wires 4*a*, 4*a*' in a connector housing 5*j*. Therefore, failed products mentioned above can be reduced and product yield can be improved.

Describing in detail, a connector housing 5*j* is provided in positioning portions 6 with pressure contact blade receiving grooves 6*b* for leading pressure contact type terminals 5*e* and pressure contact connection is done by leading a pair of the pressure contact blades 5*f* of the pressure contact type terminals 5*e* into pressure contact blade receiving grooves 6*b*. Thereby, the slits 5*i* of the pressure contact type terminals 5*e* are successfully led to contact with electric wires 4*a*, 4*a*', 4*b* such as cables 4*a*, 4*a*' provided in the receiving section 5*m* of the connector housing 5*j* when fitting the base board 2 provided with the pressure contact type terminals 5*e* i.e. the camera module Y into the camera case 3.

A pair of the pressure contact blades 5*f* of the pressure contact type terminals 5*e* dig into electric wires such as cables during the pressure contact type terminals 5*e* is guided by the pressure contact blade receiving grooves 6*b*. Therefore, a pair of the pressure contact blades 5*f* may not be expanded easily. Fitting the camera module Y including the base board 2 into the camera case 3 and electrically connecting can be simultaneously done easily and securely.

Action of a pair of the pressure contact blades 5*f* formed in the pressure contact type terminal 5*e* when connecting the pressure contact type terminals 5*e* with electric wires 4*a*, 4*a*' will be described with reference to FIGS. 6–8, 10–12. A pair of the pressure contact blades 5*f* formed in the pressure contact type terminal 5*e* are guided inwardly by the corner edges 6*e* of the pressure contact blade receiving grooves 6*b*.

Thereby, since a pair of the pressure contact blades 5*f* formed in the pressure contact type terminal 5*e* are guided by corner edges 6*e* of the pressure contact blade receiving grooves 6*b*, the pressure contact type terminal 5*e* abuts on the corner edges 6*e* of the pressure contact blade receiving grooves 6*b* and a pair of the pressure contact blades 5*f* of the pressure contact type terminal 5*e* are guided inwardly, when the pressure contact type terminals 5*e* are connected with electric wires 4*a*, 4*a*' and a pair of the pressure contact blades 5*f* of the pressure contact type terminal 5*e* may be expanded outwardly.

If a pair of the pressure contact blades 5*f* of the pressure contact type terminal 5*e* may be expanded markedly when pressure contact connecting the pressure contact type terminals 5*e* with electric wires 4*a*, 4*a*', deformation of the pressure contact blades 5*f* of pressure contact type terminals 5*e* is concerned. When the pressure contact blades 5*f* of pressure contact type terminals 5*e* are deformed, the pressure contact type terminals 5*e* and electric wires 4*a*, 4*a*' may not be connected securely. However, according to this invention, a pair of the pressure contact blades 5*f* of the pressure contact type terminal 5*e* are guided inwardly by the corner edges 6*e* of the pressure contact blade receiving grooves 6*b* and then above failure can be prevented.

Describing simply a terminal, terminals are classified into a pressure contact type terminal and a crimp contact type terminal. Regarding the pressure contact type terminal 5*e*, as mentioned above with reference to FIGS. 5–18, pressure contacting the blade portion 5*f*', formed on the pressure contact blade 5*f* of the pressure contact type terminal 5*e*, with the electric wire 4 such as the cables 4*a*, 4*a*' formed with the conductive wires 4*b*, protected by the insulation cover 4*c*, shearing the insulation cover 4*c* and connecting with the conductive wires 4*b* can be done simultaneously. A terminal provided with U-shape contact with the pressure contact slit 5*i* is a typical example. The pressure contact slit 5*i* can be called simply a slit.

On the other hand, a crimp contact type terminal is provided with a barrel portion, plastic deformed by a crimping tool to connect an electric wire mechanically and electrically. Generally, the barrel portion includes a wire barrel, for crimp contacting with a conductive wire at insulation cover removed area, and an insulation barrel for crimp contacting an insulation cover area of an electric wire. The wire barrel is classified into a closed barrel and an open barrel.

Preferably, in this invention, the pressure contact type connector 5*a* mounted on the base board 2 as shown in FIG. 1 may be replaced by a male type or female type connector with crimp contact type terminals and a portion including cables 4*a*, 4*a*' in the connector housing 5*j* may be replaced by a female type or male type connector which can be connected correspondingly with the above connector and inserting correspondingly connecting terminals to the above terminals into this connector is effective.

Furthermore, portions of the cables 4*a*, 4*a*' mounted in the connector housing 5*j* may be replaced by bus bars and ends of the bus bars may be formed into required terminal shape to connect with connector elements on the base board. Assuming to meet the objects of this invention, any type terminals and connectors can be used.

Various kind of electric circuit elements, such as bus bars, terminals and electric wires for connecting with electric wiring are provided and retained on the base board body 2'shown in FIG. 1. The base board 2 is an insulating plate to retain such electric circuits and to prevent electrical contacting between each electric circuits and can be called "insulated board".

Describing a material to form the base board 2, synthetic resin such as thermosetting resin or thermoplastic resin is preferable for good formability and good performance to insulate various electric elements such as bus bars or terminals. Any above synthetic resin with low water absorbing property is preferable on dimensional stability, volume productivity and stable electric performance.

The bus bar is made of conductive sheet metal to branch plural electric circuits and electrical circuit network with many electric contact pieces. Provided bus bars are a bus bar body, a bus bar for connectors, a bus bar for relay, a bus bar for fuse, a bus bar for power supply or the like. The bus bar for fuse is called a clamp hold type terminal or a tuning fork shape terminal by the formed shape. The bus bars may be provided with junction terminals if required.

Copper-base metal such as bronze or copper alloy and aluminum alloy may be listed as materials for the pressure contact terminal 5*e* or bus bars used in this invention. Electrical conductive metal or any kind of materials having good electrical conductivity may be used for the pressure contact terminal 5*e* or bus bars used in this invention.

Applying surface protecting process such as metal plating on above material for enhancement of corrosion resistance is preferable. If the performance can be kept enough under normal working condition without surface treatment, such surface protecting process may not be applied preferably in a viewpoint of cost.

Figure 4:
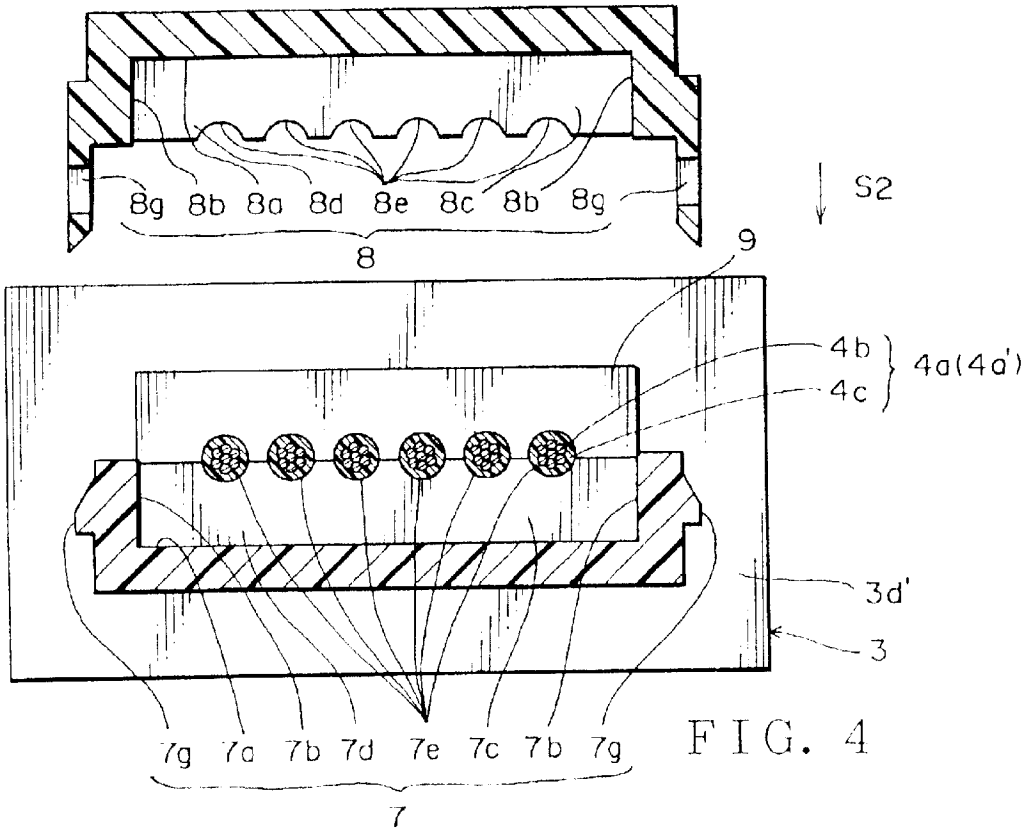
FIG. 4 is a sectional view taken along the line P—P of FIG. 1 showing the connecting case and the connecting case cover.

The camera case 3, shown in FIGS. 1 and 2, is formed with a bottom wall 3*c* and side walls 3*d*, 3*d*' standing around the bottom wall to provide a receiving section 3*e*. The camera case 3, as shown in FIGS. 1, 2 and 4, is provided with a mat seal 9 integrally molded in the side wall 3*d*' to enhance sealing performance. The mat seal 9 is provided with through holes 9*a* for inserting cables 4*a* and a drain wire 4*a*'. The cables 4*a*, 4*a*' are led from outside into an inside of the camera case 3 through the mat seal 9.

The form of the mat seal 9 will be described in detail with reference to FIG. 2. The mat seal 9 is integrally molded from a round portion of a through hole 3*f* formed in the side wall 3*d*' of the camera case 3 to a side wall 5*k*" forming an end portion of the connector housing 5*j*. The mat seal 9 is provided on a side of receiving section 3*e* of the camera case 3 with a locking portion 9*b* to prevent dropping through from the through hole 3*f* of the camera case 3. The locking portion 9*b* formed on the mat seal 9 is fixed in the camera case 3 to be integrally molded and sandwiched between an inner surface of the side wall 3*d*' of the camera case 3 and an outer surface of the side wall 5*k*" of the connector housing 5*j*.

Describing manufacturing method of the mat seal 9, firstly the camera case 3 is manufactured by aluminum casting mold method. Or, the camera case 3 is formed with synthetic resin which can be injection molded and has thermoplastic property. After pouring synthetic polymer, such as granular silicon, into the through hole 3*f* and surrounding area of the camera case 3, the mat seal 9 is formed into a required shape to solidify the polymer.

In the process, after fixing the cables 4*a*, 4*a*' in a through hole 5*m*' of the connector housing 5*j* formed in the receiving section 3*e* of the camera case 3, the cables 4*a*, 4*a*' and the mat seal 9 may be integrally molded. On the other way, molding the mat seal 9 to form the through holes 9*a* in preprocess, the cables 4*a*, 4*a*' may be inserted into the through holes 9*a* formed in the mat seal 9.

Thus, the mat seal 9 is formed integrally between the side wall 3*d*' of the camera case 3 and a side wall 5*k*" forming an end portion of the connector housing 5*j*. And the cables 4*a*, 4*a*' sealed by the mat seal 9 are inserted from a connecting case 7 toward the receiving section 5*m* of the connector housing 5*j*. The through hole 3*f* formed in the side wall 3*d*' of the camera case 3 is sealed by the mat seal 9.

Providing the mat seal 9 as mentioned above, electric wires such as the cables 4*a* and the drain wire 4*a*' can be inserted from the outside into the inside of the camera case 3 and penetration of contaminants such as water or dust into the inside of the camera case 3 can be protected.

The camera case 3 is provided on the inner four corners with screw fixing bodies 3*a*, 3*a*' to fix the camera module Y including the camera 1 and the base board 2, as shown in FIGS. 1, 2. Each screw fixing body 3*a*, 3*a*' is provided with a female tapped hole 3*b*. One female tapped hole 3*b* is formed in each screw fixing body 3*a*, 3*a*' provided on the camera case 3 and total 4 tapped holes are provided on the camera case.

Location of the four female tapped holes 3*b* will be described with reference to FIG. 1. Two screw fixing bodies 3*a* on a front side are placed higher than positions of two fixing bodies 3*a*' on a rear side. Therefore, Positions of the female tapped holes 3*b* of two screw fixing bodies 3*a* provided on the front side are placed higher than positions of the female tapped holes 3*b* of two screw fixing bodies 3*a*' provided on the rear side.

The height position difference of the screw holes, as showing the camera module Y mounted with the camera 1 and the base board 2 in FIG. 1, is for shifted height position of screw fixing bodies 1*a* on the camera 1 against height position of screw bodies 2*a* on the base board 2 to assemble combination of the camera 1 and the base board 2 into the camera case.

The camera body 1' is provided with two screw fixing bodies 1*a* and the base board body 2' is provided with two screw fixing bodies 2*a* and then combining the camera 1 and the base board 2 gives total four screw fixing bodies 1*a*, 2*a* provided on the camera module Y. When combining the camera and the base board, respective screw fixing bodies 1*a*, 2*a* will not have the same height. Therefore, as shown in FIG. 1, height difference between the screw fixing bodies 3*a*, 3*a*' of the camera case 3 is given to adjust the height position of the screw fixing bodies 1*a*, 2*a* of the camera module Y.

Preferably, the camera case 3, as showing one embodiment of the invention, may be formed with aluminum alloy by aluminum die cast to be lightweight and have many advantages on mechanical strength, anti-corrosion, manufacturability and productivity. Since CCD camera mounted on the outside of a car is exposed to the weather, anti-corrosion material is very important. Small specific gravity material is preferable to save weight in a car. For a material of the camera case 3 used for above application, aluminum alloy or synthetic resin which can be injection molded and has thermoplastic property may be preferable to be good for mass production.

The connector housing 5*j*, as shown in FIGS. 1 and 2, is formed integrally with the camera case 3 in the receiving section 3*e* of the camera case 3. The connector housing 5*j* can be provided as a separated element for the camera case 3. Preferably, the connector housing 5*j* may be formed integrally with the camera case 3 to reduce number of elements and cost. The connector housing 5*j* may be formed into a size corresponding to a shape of the pressure contact type connector 5*a*, shown in FIGS. 1, 5, 9 and 15.

The connector housing 5*j*, as shown in FIGS. 1 and 2, is provided with a receiving section 5*m* formed with a bottom wall 5k and side walls 5k', 5k" on all sides. The cables 4a and the drain wire 4a', as shown in FIGS. 1 and 2, are installed in the receiving section 5m of the connector housing 5j. Respective cables 4a, 4a' including the drain wire 4a' is held by a wire fixing portion 6h provided on the bottom wall 5k of the connector housing 5j.

The cables 4a, 4a', as shown in FIG. 2, are arranged at even intervals in a row in the receiving section 5m of the connector housing 5j. An opening portion 5n is provided on a top side of the receiving section 5m of the connector housing 5j to connect the pressure contact type terminals 5e, mounted in the pressure contact type connector 5a, with each cable 4a, 4a' installed in the receiving section 5m of the connector housing 5j.

The wire fixing portions 6h are provided in stagger on the front-and-rear and right-and-left side of each cable 4a, 4a', as shown in FIGS. 1–3. Providing adjacent wire fixing portions 6h of each other in stagger in the receiving section 5m of the connector housing 5j , the receiving section 5m of the connector housing 5j can be sized smaller. Therefore, miniaturized and weight saved auxiliary device module Z, such as a camera module Z, can be provided by miniaturizing the camera case 3.

At least two wire fixing portions 6h for fixing the cables 4a, 4a' in the receiving section 5m of the connector housing 5j are provided for one cable 4a, 4a', as shown in FIGS. 1 and 2. A pair of wire fixing portions 6h, as shown in FIG. 2, are provided on the cable 4a, 4a'. Two wire fixing portions 6h are provide along the length of the cable 4a, 4a' and total twelve wire fixing portions are provided in the receiving section 5m of the connector housing 5j.

Therefore, the cables 4a, 4a' are fixed in required position during operation of pressure contact connecting and when the pressure contact blades 5f of the pressure contact type terminal 5e, shown in FIGS. 7 and 11, are starting to shear the cables 4a, 4a', the cables 4a, 4a' can not flee from pressing force by the pressure contact blades 5f (pressure contact force) and can catch the pressure contact force securely. Thus, pressure contact connection can be done satisfactorily.

Preferably, a through hole 5m, formed in the side wall 5k" of the connector housing 5j shown in FIG. 2, may perform to fix the cables 4a, 4a' more securely, adding to fixed position by above wire fixing portions 6h.

A shape of the wire fixing portion 6h, shown in FIGS. 1–3, will be described in detail with reference to FIGS. 6 and 10. The wire fixing portion 6h is formed into gate shape with a pair of inverted L-shape portions, as shown in FIGS. 6 and 10, to hug the cables 4a, 4a'.

The wire fixing portion 6h is provide mainly with a pillar portion 6i and locking portion 6j. The pillar portion 6i of the wire fixing portions 6h extend upwardly from the pressure contact blade receiving grooves 6b formed on the bottom wall 5k of the connector housing and the locking portions 6j for preventing the cables 4a, 4a' coming out are formed on a top of the wire fixing portion 6h. The locking portion 6j is formed with a slant portion 6k, a bend portion 6k' and an edge portion 6m.

A pair of the wire fixing portions 6h are formed with the slant portions 6k to be bent at the bend portions 6k' as closing the edge portions 6m of the wire fixing portions 6h to each other. The bend portion 6k' may be curved shape or curved from the pillar portion 6i to the slant portion 6k of the wire fixing portion 6h.

The edge portions 6m and side edges of a pair of the electric wire fixing portions 6h hug the cables 4a, 4a' and touch surfaces of the cables 4a, 4a' to hold the cables. Thus, a pair of the electric wire fixing portions 6h fix the cables 4a, 4a'.

The edge portion 6m is formed into a slant surface going down toward the electric wire setting portion 6a to fit the cables 4a, 4a' easily on the electric wire fixing portion 6h when fixing the cables 4a, 4a' on the electric wire fixing portion 6h.

The minimum gap distance 6n between one edge portion 6m and the other edge portion 6m of the electric wire fixing portions 6h is dimensioned to be smaller than a diameter of the cable 4a, 4a' for preventing the cables 4a, 4a' coming out from the wire fixing portions 6h and also to fit the cable 4a, 4a' easily into the wire fixing portions 6h.

The electric wires 4a, 4a' such as cables 4a, 4a' are fixed actually by three points of two side edges of the edge portions 6m of a pair of the electric wire fixing portions 6h and one supporting portion 6d formed on the top of the pillar portion 6c of the electric wire setting portion 6a. Thus, fixing the cables 4a, 4a' by the three points of a pair of the electric wire fixing portions 6h and the supporting portion 6d of the electric wire setting portion 6a, the cables 4a, 4a' are held stably in the connector housing.

The shape of the supporting portion 6d formed on the top of the pillar portion 6c of the electric wire setting portion 6a is formed into in-curved shape correspondingly to an outline surface of the electric wires 4a, 4a' such as the cables 4a, 4a' and then it is easy to set the cables 4a, 4a' stably on the supporting portion 6d of the electric wire setting portion 6a.

Since the width of the pillar portion 6c of the electric wire setting portion 6a is dimensioned to be narrower than the width of the pressure contact slit 5i of the corresponding pressure contact type terminal 5e, the top edge portion of the pressure contact type terminal 5e can be received satisfactorily into the pressure contact blade receiving grooves 6b, as shown in FIGS. 8, 12-14.

Dimensioning the width of the pillar portion 6c of the electric wire setting portion 6a narrower than the width of the pressure contact slit 5i of the corresponding pressure contact type terminal 5e, pressure contact connecting may be done expectably by the pillar portion 6c of the electric wire setting portion 6a guiding the pressure contact slit 5i of the corresponding pressure contact type terminal 5e. Thereby, pressure contact connecting may be done more stably and more securely.

Some clearance between the cables 4a, 4a' and the pressure contact blade 5f is required to accept error of positioning each elements or position moving during pressure contact connection. Therefore, the length between one inner surface and the other inner surface of the pillar portion 6i, provided in the wire fixing portion 6h is dimensioned to be longer than a diameter of the cable 4a, 4a' as allowance for positioning error during pressure contact connection.

If the cables 4a, 4a' are fixed during operation of pressure contact connecting, as mentioned above, when the pressure contact blade 5f of the pressure contact type terminal 5e is starting to shear the cables 4a, 4a', the cables 4a, 4a' can accept the pressure contact force on the pressure contact blade 5f. Then, pressure contact connection can be done satisfactorily without the cables 4a, 4a' shifting.

The wire fixing portion 6h may be formed with synthetic resin which can be injection molded and has thermoplastic property. The wire fixing portion 6h can be integrally molded with the connector housing 5j by the same material or may be molded as a separated element by each different material and be mounted in the receiving section 5m of the connector housing 5j.

The cables 4*a*, 4*a*', connected by pressure contact, are bundled by the tube 4*d*, as shown in FIG. 2, to form into the wire harness 4 which is connected with specific portions in a car. The wire harness may be formed with a dummy wire added on the cables 4*a*, 4*a*' to be connected with other electric circuits if required.

The wire harness 4 connects the camera case 3 and the non-waterproof connector 5*r* installed in the inside-of-car V. The drain wire 4*a*', branched from a middle point of the wire harness 4, is provided at one end with a terminal 5*s* and the terminal 5*s* is fixed on a frame of a car body B with a screw 13*c*. The drain wire 4*a*' performs earth ground. Thus, the base board 2 including the camera 1, the wire harness 4, the non-waterproof connector 5*r* installed in the inside-of-car V and the drain wire 4*a*' are connected electrically to each other.

The connecting case 7, as shown in FIGS. 1, 2 and 4, is provided on the side wall 3*d*' of the camera case 3. A connecting case cover 8 is provide to be mounted correspondingly on the connecting case 7. The connecting case 7 and the connecting case cover 8 are provided to prevent over loading of bending force on the wire harness 4 and protect the cables 4*a*, 4*a*' coming out from the tube 4*d* of the wire harness 4 and the mat seal 9 for inserting the cables and place the cables 4*a*, 4*a*' coming out from the tube 4*d* of the wire harness 4 in a row.

The connecting case 7 may be formed integrally with the camera case 3 or may be mounted on the camera case 3 as a separated element from the camera case 3. Preferably, the connecting case 7 may be formed integrally with the camera case 3 to reduce number of elements.

The connecting case 7 is provided with a receiving section 7*c* formed with a bottom wall 7*a* and side walls 7*b*, 7*b*' around the bottom wall 7*a*. The connecting case 7 is provided in the receiving section 7*c* with a guide plate 7*d* to arrange the cables 4*a*, 4*a*' in parallel and in a row. The number of guide grooves 7*e* as the same number, for example 6, of the cables 4*a*, 4*a*', as shown in FIG. 4, is provided at even intervals on a top side of the guide plate 7*d* to fix the cables 4*a*, 4*a*' in a row. A wire guide portion 7*f* for guiding the wire harness 4 is formed along a fitting direction to the wire harness 4 and extending from the side wall 7*b*', as shown in FIGS. 1 and 2, to prevent over loading of bending force on the wire harness 4.

A connecting case cover 8 is provide to be mounted correspondingly on the connecting case 7, as shown in FIGS. 1 and 4. FIG. 4 is a sectional view taken along the line P—P of FIG. 1 showing the connecting case 7 and the connecting case cover 8. The connecting case cover 8 is provided with a receiving section 8*c* formed with a top wall 8*a* and side walls 8*b*, 8*b*' around the top wall 8*a*.

A guide plate 8*d*, having guide grooves 8*e* corresponding to the guide grooves 7*e* formed in the guide plate 7*d* of the connecting case 7, is provided in the connecting case cover 8. Describing in detail, the guide plate 8*d* for placing the cables 4*a*, 4*a*' in parallel and in a row is provided in the receiving section 8*c* of the connecting case cover 8.

The number of guide grooves 8*e* as the same number, for example 6, of the cables 4*a*, 4*a*' are provided at even intervals on a bottom side of the guide plate 8*d* to fix the cables 4*a*, 4*a*' in a row. A wire guide portion 8*f* for guiding the wire harness 4 is formed along a fitting direction to the wire harness 4 and extending from the side wall 8*b*', as shown in FIG. 1, to prevent over loading of bending force on the wire harness 4.

The guide grooves 7*e*, Be for fixing the cables 4*a*, 4*a*' separated from the wire harness 4 are provided at even intervals on the connecting case 7 and corresponded connecting case cover 8. Fixing the connecting case cover 8 on the connecting case 7 from mount direction S2 shown in FIG. 4, each cable 4*a*, 4*a*' is clamped and fixed by the guide grooves 7*e* of the connecting case 7 and the guide grooves 5*e* of the connecting case cover 8. The guide plate 7*d*, 8*d* having guide grooves 7*e*, Be may be called a rib.

Fixing the connecting case cover 8 on the connecting case 7, the wire guide portion 7*f* formed on the connecting case 7 and the wire guide portion 5*f* formed on the connecting case cover 8 are combined to prevent over loading of bending force on the wire harness 4.

Since the wire guide portions 7*f*, 8*f* for the electric wire 4 such as the wire harness 4, are provided on the connecting case 7 and the corresponded connecting case cover 8 as shown in FIGS. 1 and 2, the cables 4*a*, 4*a*' can not be bent with a sharp corner on a mounting area of camera case 3 and prevented over loading of bending force on them, during arranging the wire harness 4 or handling the assembled camera module Z.

The connecting case 7 and the connecting case cover 8, as shown in FIGS. 1 and 4, are fixed securely by a pair of locking portions 7*g* provided outside of the side walls 7*b* of the connecting case 7 and a pair of engaging portions 8*g* provided outside of the side walls 8*b* of the connecting case cover corresponding to the locking portions 7*g*. Fitting the convex shape locking portion 7*g* into the engaging portions 8*g* provided with engaging openings corresponding to the locking portions, the connecting case 7 and the connecting case cover 8 are fixed.

The connecting case cover 8 is made of synthetic resin by injection molding. As shown in this embodiment, forming with synthetic resin which can be injection molded and has thermoplastic property is preferable for mass production. Not only injection molding but also the other manufacturing method can be used. Forming not only the connecting case cover 8 but also the camera case 3 integrally with the connecting case 7 by injection molding with synthetic resin which can be injection molded and has thermoplastic property is good mass productivity for any complicated shape, in this invention.

A molded body with synthetic resin may have good spring back force potentially inside. If the connecting case cover 8 is formed by synthetic resin molding, during fitting the engaging portions 8*g* of the connecting case cover 8 into the locking portion 7*g* of the connecting case 7 shown in FIGS. 1 and 4, the engaging portion 8*g* is elastically deformed temperately and the locking portion 7*g* goes easily into the engaging opening of the engaging portion 8*g* and then the connecting case 7 and the connecting case cover 8 are fixed rapidly and easily.

As synthetic resin which can be injection molded and has thermoplastic property, polybutylene terephthalate (PBT for short), acrylonitrile butadiene styrene (ABS for short) and polypropylene (PP for short) are given examples. The connecting case cover 8 used in this invention is made of polybutylene terephthalate (PBT) as an example which has good stability on dimension and strength and good electrical characteristics. PBT-HOl is given an example as PBT materials.

Regarding manufacturing method of the auxiliary device module Z such as the camera module Z, an example for assembling process and method of the camera module Z will be described with reference to FIGS. 1–18.

Terminals such as various pressure contact type terminals 5*e* and various bus bars are manufactured to be respective required shapes by punching and bending process with metals for terminals. In other process, the base board 2 is formed with thermosetting resin or the like and the connector housing 5*b* is injection molded with thermoplastic resin. The various bus bar, the connector housing provided with the pressure contact type terminals 5*e* and other various electric elements are mounted on the base board 2.

The camera 1 provided with the lens 1*c*, the lens area portion 1*d* and camera body 1' shown in FIG. 1 is prepared in preprocess. The camera module Y is prepared to mount the camera 1, the pressure contact type connector 5*a* provided with the pressure contact type terminals 5*e* and other various electric circuits on the base board 2 in preprocess, as shown in FIG. 1.

The camera case 3 formed integrally with the connector housing 5*j* and the connecting case 7 shown in FIGS. 1 and 2, the connecting case cover 8 shown in FIGS. 1 and 4, the wire fixing portion 6*h* shown in FIGS. 3, 6 and 10 are molded with synthetic resin which can be injection molded and has thermoplastic property in other process. The wire fixing portion 6*h* may be mounted on a required position in the connector housing 5*j* , as shown in FIGS. 1–3, 6 and 10, or may be formed integrally with the connector housing 5*j* by the same material.

Regarding the wire harness 4 shown in FIGS. 1 and 2, the cables 4*a* and the drain wire 4*a*' are prepared to come out with required length from the tube 4*d* by shearing the tube 4*d* in preprocess.

The cables 4*a*, 4*a*' are inserted through the through hole 5*m*' formed in the side wall 5*k*" of the connector housing 5*j* provided in the camera case 3 and set into the wire fixing portion 6*h* provided in the receiving section 5*m* of the connector housing 5*j*. Each of the cables 4*a*, 4*a*' is fixed securely in two positions by the wire fixing portion 6*h*.

The cables 4*a*, 4*a*' may be fixed on the side wall 5*k*" with adhesive to fix the cables 4*a*, 4*a*', inserted through the through hole 5*m*' provided in the side wall 5*k*" of the connector housing 5*j*, on the side wall 5*k*" securely, if required.

The cables 4*a*, 4*a*' are also set in a row into the guide grooves 7*e* formed on the guide plate 7*d* of the connecting case 7, as shown in FIGS. 1, 2 and 4. After pouring synthetic polymer, such as granular silicon, into the through hole 3*f* and surround area of the camera case 3, the mat seal 9 is formed into a required shape to solidify the polymer.

The base board 2 having the camera 1 and the pressure contact type connector 5*a*, i.e. the camera module Y, is fit into the camera case 3. During this assembling operation, the pressure contact blades 5*f* of the pressure contact type terminals 5*e*, mounted in the pressure contact type connector 5*a*, shears the insulation cover 4*c* of the cables 4*a*, 4*a*' fixed on the connector housing 5*j* and contacts with the conductive wires 4*d* simultaneously and then internal connecting in the camera module z is done. In the process, the pressure contact type terminal 5*e* is led into the pressure contact blade grooves 6*b* formed on the bottom wall 5*k* of the connector housing 5*j* and then pressure contact connection can be done satisfactorily. Thus, the base board 2 and the camera case 3 are electrically connected by the connector 5.

Specifically, connecting by the pressure contact type terminal 5*e*, assembling and electrical connecting can be done effectively and simultaneously in the process. In this invention, other type of female-male connector may be used. Regarding connecting by the pressure contact type terminals 5*e*, shearing the insulation cover 4*c* and connecting with conductive wire 4*b* can be done simultaneously, as mentioned above, and then such connecting method is effective. After stripping insulation covers of cables to make inner conductive wires come out and connecting the conductive wires with crimp type terminals by prior art, each corresponded crimp type terminals are connected. Therefore, connection by pressure contact type terminals can save labor operation to connect each corresponded crimp type terminals.

Figure 22:
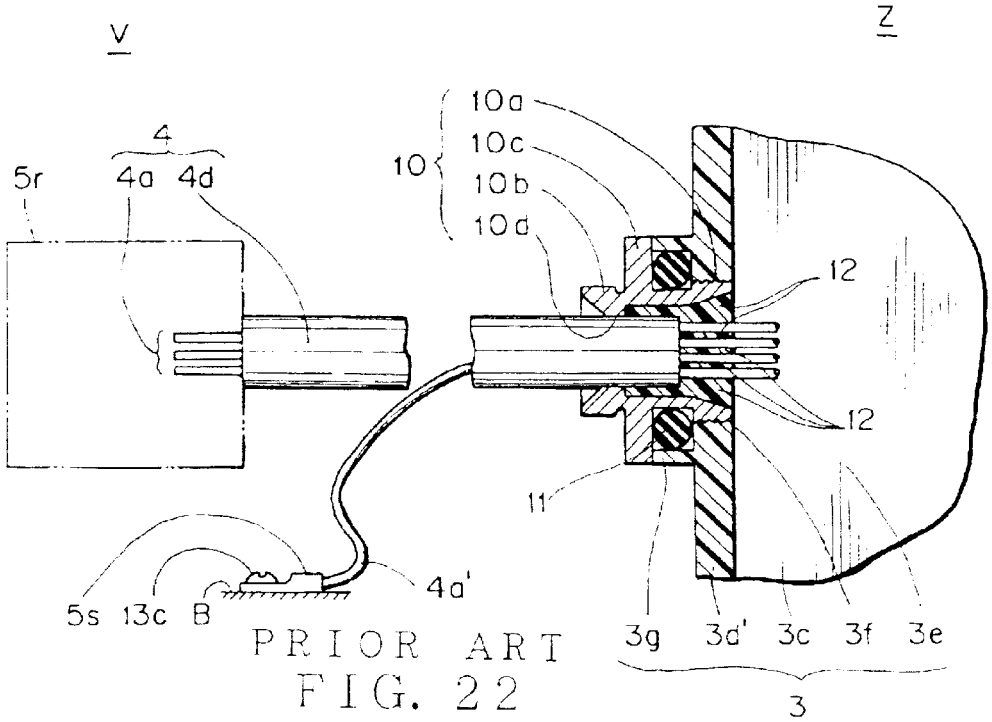
PRIOR ART FIG. 22
FIG. 22 is a conceptual drawing, showing a partial expanded sectional view taking along the line R2—R2 of FIG. 20, 21 and condition of connecting the wire harness.

Assembling the camera module Z by such process, electrical connection can be done by fitting the base board 2 provided with the camera 1 into the camera case 3. As prior art shown in FIGS. 20–22, joining the connector housing 5*q* having terminals with the cables 4*a*, 4*a*' and inserting the connector housing into the through hole 3*f* of the camera case 3 and connecting the connector housing with the connector housing 2*c* provided with terminals and mounted on the base board body 2', the base board 2 and the wire harness 4 are electrically connected. The camera module Z can be assembled by pressure contact type terminals without such operation. Thus, assembling operation by this invention can be simplified more than that by prior art and then assembling operation can be simplified and more rapid and operating efficiency can be improved.

A trouble of the camera module Z by prior art during assembling can be solved. The trouble that the cables 4*a*, 4*a*' are bitten by a gap between the base board 2 and camera case 3 during fitting the base board 2 having the camera 1 into the camera case 3 can be prevented. In this invention, the base board 2 provided with the camera 1 and the camera case 3 are connected by the pressure contact type connector 5*a* and then the trouble of biting cables 4*a*, 4*a*' is not concerned.

Specifically, during mounting the camera module Y on the camera case 3 by prior art as shown in FIG. 21, extra length portions of the cables 4*a*, 4*a*' come out from a gap between the camera module Y and the camera case 3 and the coming out portions of the extra length of the cables 4*a*, 4*a*' are bitten. In this invention, such trouble is not occurred.

Therefore, an operator is not required to pay over attention to prevent biting the cables 4*a*, 4*a*' between the base board 2 and the camera case 3 during assembling the base board 2 and the camera case 3. In automatic assembling machines, the automatic assembling machines are not stopped by biting the cables 4*a*, 4*a*' and yield down of the camera module Z in process by damaged cables by biting is not concerned.

After putting the camera module Y, shown in FIG. 1, into the camera case 3 in mount direction S1, four screws 13*a* are inserted into the screw through hole 1*b*, 2*b* formed in each screw fixing portion 1*a*, 2*a*. Respective screw 13*a* is fastened by a screwdriver into each female tapped hole 3*b* of each screw fixing body 3*a*, 3*a*' provided on the four corners of the camera case 3. During the operation, pressure contact connection may be going securely. A case cover for protecting an auxiliary device such as the camera 1 may be mounted on the case 3 simultaneously, if required.

In above operation, simultaneously mounting the connecting case cover 8 on the connecting case 7 as shown in FIG. 4, the cables 4*a*, 4*a*' are fixed securely by the guide grooves 7*e* formed in the guide plate 7*d* of the connecting case 7 and the guide grooves 8*e* formed in the guide plate 8*d* of the connecting case cover 8. Thus, the camera module Z is assembled in above process.

Any kind of additional elements, such as a case cover, may be mounted on the auxiliary device module according to this invention, based on requirements as mentioned above. Some additional elements such as the case cover may be eliminated based on a used position of the auxiliary device or a mounting position of the auxiliary device. Thereby, number of elements can be reduced and then the auxiliary device module can be miniaturized and saved in weight and a lower cost auxiliary device module can be provided.

The auxiliary device module Z according to this invention can be applied not only for the camera module Z mentioned above but also auxiliary device modules Z used for an instrument panel of a car or other related area and can be applied for any other area for modularization.

The camera module Z provided with the camera 1 including CCD, as the auxiliary device 1, for a car is preferable in any auxiliary device modules. Applying the auxiliary device module Z according to the invention for camera module Z mounted in a car, number of elements related with the camera module Z can be reduced and then, the camera module Z mounted in a car can be miniaturized and the weight and the cost also can be reduced.

Figure 19:
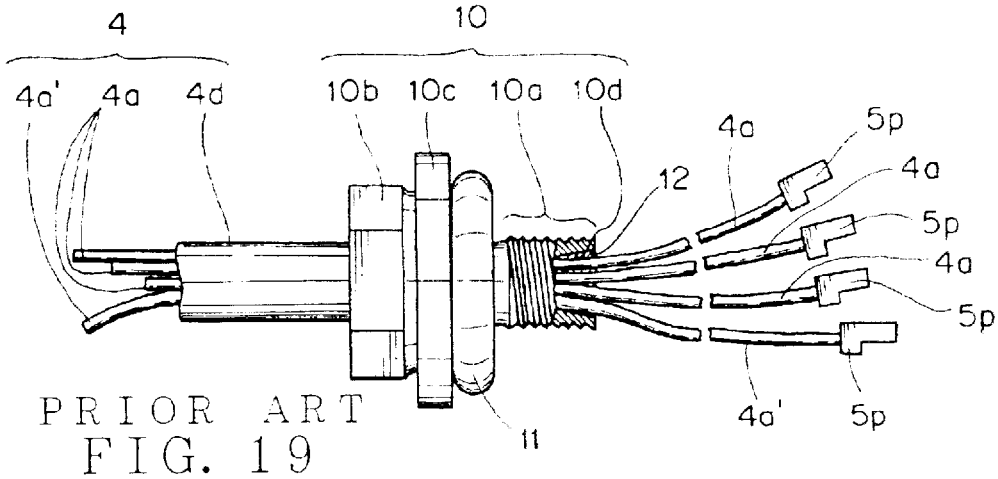
PRIOR ART FIG. 19
FIG. 19 is a partial expanded view of a wire harness mounted with a clamp having an O-ring.
Figure 20:
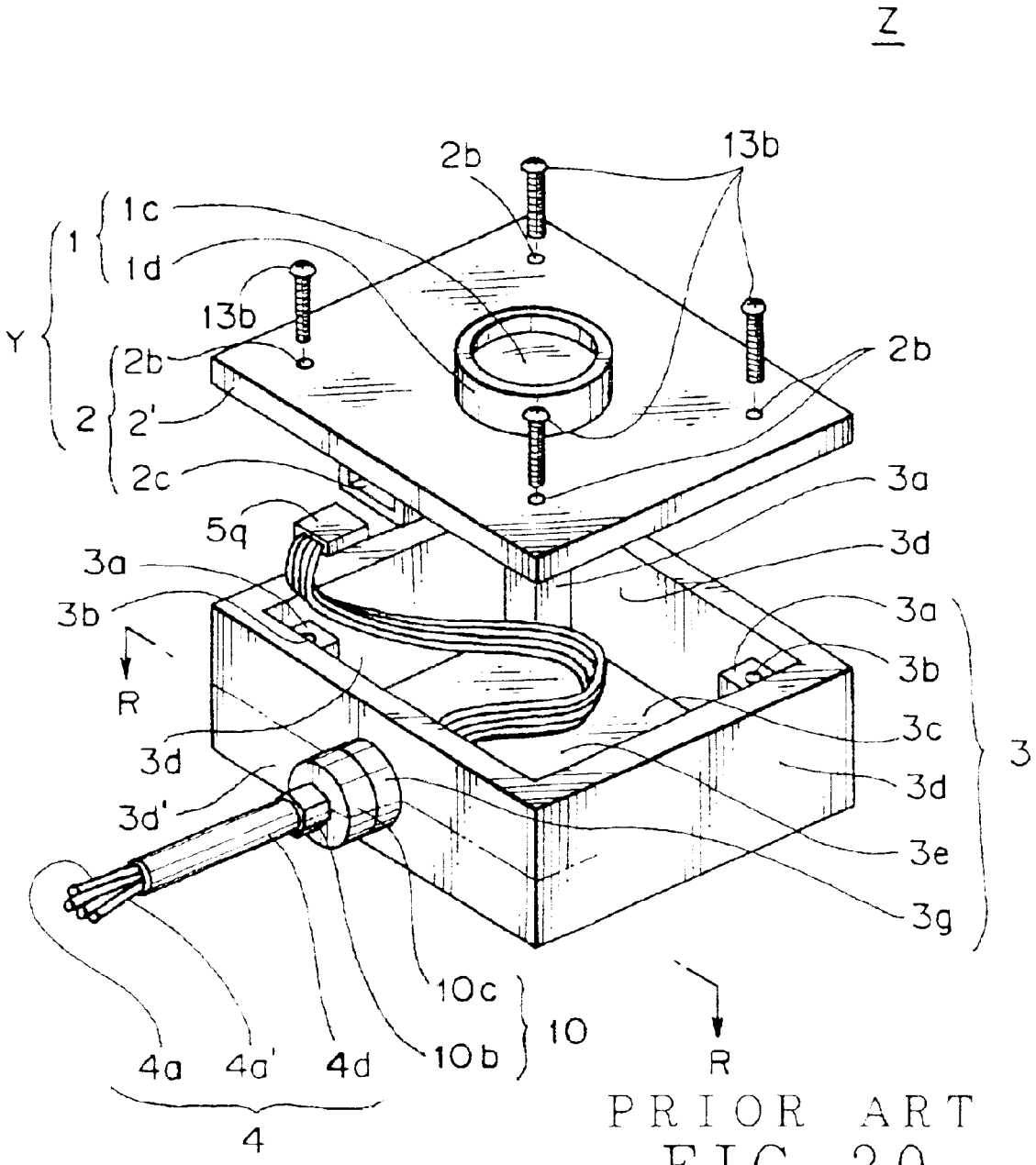
PRIOR ART FIG. 20
FIG. 20 is a perspective views, showing assembling process of camera modules by prior art.

Assembling structure of the camera 1, the base board 2 and the camera case 3 for a car is simplified. Describing specifically, using pressure contact type terminals 5*e* as show in FIGS. 1, 5–18, the structure differs from a current camera module Z which has a wire harness 4 including a clamp 10 with O-ring 11 shown in FIG. 19 or a camera module Z by prior art, shown in FIG. 24, in which crimp contact type terminals 5*p* are joined with the cables 4*a*, 4*a*' and the assembly is set into the connector housing 5*q* and the connector housing 5*q* is connected with the connector housing 2*c* for the base board 2 as shown in FIGS. 20, 21 and then electrical connection is done.

According to this invention, using pressure contact type terminals 5*e* provided in the pressure contact type connector 5*a*, shown in FIGS. 1, 5 and 9, to connect electrically from a camera 1 to a wire harness 4 by pressure contact connecting as shown in FIGS. 10–14, inspection, disassemble and repair can be done easily and also the camera module having good recyclability can be provided.

The camera module Z according to this invention is preferably used as an auxiliary member to ascertain safety of a dead angle to be installed in positions to look from a inside of a vehicle such as a dead angle area in front of a vehicle or rear area of a vehicle such as a normal size car or a large size car like a bus.

When a CCD camera installed on a outside of a car rear area strikes against others during moving back and checking or repairing of the CCD camera is required, a CCD camera according to this invention is easily disassembled and then the damaged CCD camera can be disassembled easily and repaired and reinstalled on the car. Therefore, a module according to this invention is used preferably as a CCD camera for ascertaining visually installed on a outside of a car rear area.

When a CCD camera or related elements installed on a car has a trouble such as a fault, removing , checking and repairing of them are required. A camera module Z according to this invention, which can be easily installed and removed, has good maintainability. Since the camera module Z is disassembled easily, the camera module Z is easily recycled in case of scrapping and then conform to a environmental issue by industrial waste.

What is claimed is:

1. An auxiliary device module comprising:

an auxiliary device;

a base board provided with said auxiliary device and a plurality of terminals each with a pair of leading pressure contact blades with a predetermined shape;

a case in which said base board is mounted;

a connecting portion provided in said case and including at least one wire; and a plurality of wire fixing portions hugging the at least one wire, with at least one of said wire fixing portions including a pillar portion and a locking portion on the pillar portion;

wherein said terminals on the base board and said connecting portion in said case are electrically connected by mounting said base board on the case;

wherein positioning portions have a plurality of pressure contact receiving grooves each being pre-formed with a complimentary shape as the predetermined shape of each of the pair of leading pressure contact blades so as to accommodate each of the pair of leading pressure contact blades; and wherein said wire fixing portions extend upwardly from the receiving grooves.

2. The auxiliary device module according to claim 1, wherein said terminals are pressure contact terminals, wherein said at least one wire corresponds to a plurality of electric wires, wherein a pressure contact connector provided with said pressure contact terminals is mounted on said base board, wherein said case is provided with a connector housing having said electric wires therein, wherein said pressure contact connector is formed by press-fitting said base board into said case to connect said pressure contact terminals with said electric wires by pressure, wherein said positioning portions include electric wire setting portions and pressure contact blade receiving grooves, wherein pressure contact connecting of the terminal and the electric wires is done by leading pressure contact blades of said pressure contact terminals into said pressure contact blade receiving grooves.

3. The auxiliary device module according to claim 2, wherein a pair of said pressure contact blades formed in said pressure contact terminals are guided by corner edges of said pressure contact blade receiving grooves.

4. The auxiliary device module according to claim 1, wherein a camera module is built with a car-mount type camera as said auxiliary device.

5. The auxiliary device module according to claim 2, wherein a camera module is built with a car-mount type camera as said auxiliary device.

6. The auxiliary device module according to claim 3, wherein a camera module is built with a car-mount type camera as said auxiliary device.

7. An auxiliary device module comprising:

an auxiliary device;

a base board provided with said auxiliary device and a plurality of terminals each with a pair of leading pressure contact blades with a predetermined shape;

a case in which said base board is mounted;

a connecting portion provided in said case and including at least one wire; and a plurality of wire fixing portions hugging the at least one wire, with at least one of said wire fixing portions including a pillar portion;

wherein said terminals on the base board and said connecting portion in said case are electrically connected by mounting said base board on the case;

wherein positioning portions have a plurality of pressure contact receiving grooves each being pre-formed with a complimentary shape as the predetermined shape of each of the pair of leading pressure contact blades so as to accommodate each of the pair of leading pressure contact blades;

wherein each of said receiving grooves is formed with a groove bottom portion and two slant portions; and wherein the pillar portion extends upwardly from at least one of the slant portions of the receiving grooves.

8. An auxiliary device module comprising:

an auxiliary device;

a base board provided with said auxiliary device and a plurality of terminals each with a pair of leading pressure contact blades with a predetermined shape;

a case in which said base board is mounted;

a connecting portion provided in said case and including at least one wire; and a plurality of wire fixing portions hugging the at least one wire;

wherein said terminals on the base board and said connecting portion in said case are electrically connected by mounting said base board on the case;

wherein positioning portions have a plurality of pressure contact receiving grooves each being pre-formed with a complimentary shape as the predetermined shape of each of the pair of leading pressure contact blades so as to accommodate each of the pair of leading pressure contact blades;

wherein each of said receiving grooves is formed with a groove bottom portion and two slant portions; and wherein said wire fixing portions extend upwardly from the slant portions of the receiving grooves, wherein said wire fixing portions comprise:

pillar portions extending upwardly from the slant portions of the receiving grooves; and locking portions on the pillar portions;

wherein the at least one wire is at least partly covered by an insulation cover.

9. The auxiliary device module according to claim 8, wherein the locking portions touch a surface of the insulation cover.

* * * * *